US007052444B2

(12) United States Patent
Webber

(10) Patent No.: US 7,052,444 B2
(45) Date of Patent: May 30, 2006

(54) COMPOSITE MOTION EXERCISE MACHINE

(76) Inventor: Randall T. Webber, 100 Harbor Dr. #1404, San Diego, CA (US) 92101

( * ) Notice: Subject to any disclaimer, the term of this patent is extended or adjusted under 35 U.S.C. 154(b) by 643 days.

(21) Appl. No.: 10/171,236

(22) Filed: Jun. 12, 2002

(65) Prior Publication Data

US 2003/0232703 A1 Dec. 18, 2003

(51) Int. Cl.
*A63B 21/06* (2006.01)
*A63B 23/04* (2006.01)
*A63B 23/12* (2006.01)

(52) U.S. Cl. ..... 482/93; 482/72; 482/96; 482/97; 482/100; 482/101; 482/135; 482/137

(58) Field of Classification Search ..... 482/72, 482/93–101, 135, 137, 146, 132; D21/674
See application file for complete search history.

(56) References Cited

U.S. PATENT DOCUMENTS 2,252,156 A 8/1941 Bell
2,455,548 A * 12/1948 Bell ..... 482/96
2,642,288 A * 6/1953 Bell ..... 482/96
4,004,801 A 1/1977 Campanaro et al.
4,300,760 A 11/1981 Bobroff
4,387,893 A 6/1983 Baldwin
4,511,137 A 4/1985 Jones
4,828,254 A 5/1989 Maag
4,949,958 A 8/1990 Richey
5,106,080 A 4/1992 Jones
5,106,081 A 4/1992 Webb
5,135,449 A 8/1992 Jones
5,217,422 A 6/1993 Domzalski
5,299,997 A 4/1994 Chen
5,330,405 A 7/1994 Habing et al.
5,346,447 A 9/1994 Stearns
5,366,432 A 11/1994 Habing et al.
5,409,440 A 4/1995 Yang
5,484,365 A 1/1996 Jones et al.
5,520,599 A * 5/1996 Chen ..... 482/96
5,554,086 A 9/1996 Habing et al.
5,580,340 A 12/1996 Yu
5,603,678 A 2/1997 Wilson
5,616,107 A 4/1997 Simonson
5,620,402 A 4/1997 Simonson
5,626,542 A * 5/1997 Dalebout et al. ..... 482/96
5,628,715 A 5/1997 Simonson
5,722,917 A 3/1998 Olschansky et al.

(Continued)

OTHER PUBLICATIONS

Rower, Gym 80 Brochure, 2001.

(Continued)

*Primary Examiner*—Gregory L. Huson
*Assistant Examiner*—Victor K. Hwang
(74) *Attorney, Agent, or Firm*—Gordon & Rees LLP

(57) ABSTRACT

A composite motion exercise machine has a main frame device, a user support device pivotally linked to the main frame, an exercise arm device pivotally linked to the main frame device, a slide rail mounted on a first one of said devices, and a traveling member engaging the slide rail for movement along the rail. A first connecting link has a first end connected to the traveling member, and a second end linked to a fixed position on a second one of said devices. A further connection device links the traveling member to the exercise arm device, such that movement of the exercise arm is transferred to the user support to lift the support and user.

34 Claims, 21 Drawing Sheets

U.S. PATENT DOCUMENTS

| | | | | |
|---|---|---|---|---|
| 5,733,229 | A | 3/1998 | Dalebout et al. | |
| 5,827,158 | A * | 10/1998 | Drecksel | 482/96 |
| 5,899,836 | A | 5/1999 | Chen | |
| 5,928,116 | A | 7/1999 | Chiang | |
| 5,964,684 | A | 10/1999 | Sokol | |
| 6,015,369 | A | 1/2000 | Rasmussen | |
| 6,152,866 | A | 11/2000 | Kuo | |
| 6,220,993 | B1 | 4/2001 | Sencil | |
| 6,264,588 | B1 | 7/2001 | Ellis | |
| 6,287,241 | B1 | 9/2001 | Ellis | |
| 6,916,278 | B1 * | 7/2005 | Webber | 482/96 |

OTHER PUBLICATIONS

Abdominal Multi-Joint Machine, Gym 80 Brochure, 2001.
Back Stretch Multi-Joint Machine, Gym 80 Brochure, 2001.
Leg Press Machine, Gym 80 Brochure, 2001.
Schwinn Natural Strength Advertisement, Date Unknown.

* cited by examiner

COMPOSITE MOTION EXERCISE MACHINE

BACKGROUND OF THE INVENTION

The present invention relates to composite motion exercise machines in which both the actuating member and the user support move in a dependent relationship, and is particularly concerned with an exercise machine using a sliding linkage lifting system to displace the user support.

Exercise machines are divided into two major categories, single function and multi-function. A single function exercise machine performs one specific exercise to train a specific set of muscles. These machines are generally used in health clubs and gyms, where it is preferred for a user to perform one exercise on a specific machine for that exercise, and then to move on to another machine to perform a different exercise. Multi-function machines have different exercise stations for performing different exercises, using various muscle groups. Such machines are commonly used for in-home training, because of their space efficient design. Many types of single and multi-function machines have been designed in the past, most of which have a stationary seat or user support with an exercise arm or device linked to a load. Some have a stationary foot plate or actuating member and a movable user support.

Other, composite motion exercise machines are known in which both the actuating member and the user support move during exercise. In U.S. Pat. No. 5,330,405 of Habing et al., various exercise arms are attached to a movable user support sub-frame, which is connected to the main frame via a four bar linkage system. A lever arm is pivotally attached to the main frame and coupled through a cable and pulley system to the exercise arms and sub-frame. The lever arm has a movable carriage which bears against the lower links of the four bar linkage system. The load is supplied by the user's body weight, which can be increased or decreased by adjusting the position of the carriage along the lever arm and changing its contact point relative to the four bar linkage.

Other composite motion machines are described in U.S. Pat. No. 5,346,447 of Stearns, 5,733,229 of Dalebout et al., 5,928,116 of Chiang, and 6,015,369 of Rasmussen. U.S. Pat. Nos. 6,264,588 and 6,287,241 of Ellis describe a composite motion exercise machine comprising a main frame, slide rails attached to the main frame, an exercise arm pivotally secured to the main frame, a user engagement means attached to the exercise arm, a user support pivotally connected to the main frame, second slide rails attached to the user support, and a truck or slide linkage slidably engaged with the rails on the main frame and user support so that movement by the exercise arm moves the truck along the rails, forcing the user support to pivot and lift relative to the main frame. The load is attached to the user support. This requires two separate slide rails and linear bearings, increasing expense, and also requires a relatively long linear travel distance of the truck along the slide rails when the exercise arm is moved from the start to the ending position.

SUMMARY OF THE INVENTION

It is an object of the present invention to provide a new and improved composite motion machine.

According to one aspect of the present invention, an exercise machine is provided, which comprises a stationary main frame, a user support pivotally linked to the main frame, an exercise arm pivotally linked to the main frame, at least one slide rail on one of the main frame, user support, and exercise arm, a traveling member engaging the slide rail for movement along the rail, a first connecting link having opposite first and second ends, the first end of the connecting link being connected to the traveling member, and the second end of the connecting link being secured at a fixed position on the user support or main frame, and a connection device linking the traveling member to the exercise arm.

The slide rail may be provided on the main frame or the user support and a linear slide or a roller may engage the slide rail for travel back and forth along the rail. Where the slide rail is provided on the main frame, the first connecting link is a pivoting arm which is secured to the linear slide or roller at one end and to the user support at the other end. If the slide rail is provided on the user support, the first connecting link is a pivoting arm which is secured to the linear slide or roller at one end and to the main frame at the other end. If the traveling element is a linear slide, the pivoting arm is pivoted to the linear slide at one end and to the main frame or user support at the other end. If the traveling element is a roller, the round shape of the wheel automatically adjusts to the position on the rail, such that there is no need for a pivot attaching the pivoting arm to the roller. In another embodiment, the slide rail may be pivotally mounted on the exercise arm, and the traveling member may be linked to the user support by the first connecting link.

In another embodiment of the invention, a first slide rail is provided on the main frame and a second slide rail is provided on the user support, with first and second traveling members such as a wheel or linear slider movably mounted on the respective slide rails. A first connecting link connects the first traveling member to the user support, while a second connecting link connects the second traveling member to the main frame, with the two connecting links crossing over in a scissors-like fashion and pivotally connected at their intersection. In this scissoring dual slide and linkage system, when the exercise arm is moved, the scissoring connecting linkage will force the slides to move and the links to "scissor", forcing the user support to move. With this arrangement, the user support may be only indirectly pivoted on the main frame via the scissoring linkage system, and does not need to directly pivot on either the main frame or exercise arm.

The exercise arm may have any suitable engagement means for engaging part of the user's body. The engagement means may be one or more handles, a strap, a roller, a pad, a flat foot plate, or the like, as is common in the field. The engagement means may be pivotally or fixedly attached to the exercise arm.

The connection device linking the traveling member to the exercise arm may be any suitable linking system known in the field, such as a belt, cable, chain, rope, tie rod, arm, or cable and pulley system. A load or exercise resistance may suitably connected to any of the moving parts to provide additional resistance in addition to the weight of the user and the moving user support. The load may be in the form of weight plates, a weight stack, air or hydraulic resistance, electric or magnetic resistance, tension springs, bands, or rods, or any other form of exercise resistance known in the field.

In some embodiments of the invention, the arrangement is such that the exercise arm will travel faster and over a greater distance than the user support and the load connected to the user support. This produces a decrease in resistance felt by the user at the engagement area on the exercise arm, versus the true amount of the load applied at the user support. This decrease helps to reduce the inertia in the user support that builds during the exercise movement, and provides a more stable, comfortable exercise motion. It also allows the user to perform ballistic, explosive, or plyametric exercise movements while maintaining control of the load and exercise arm. Careful, controlled movements at reduced resistance are important and particularly beneficial in injury rehab, while explosive first step movements are often required for sports training. However, this invention also allows for arrangements in which the exercise arm and user support travel at the same speed and distance and for the resistance felt by the user to be 1:1 with the load. It is also possible for the user support to be arranged to move faster and farther than the exercise arm, and for the resistance felt by the user to be greater than a 1:1 ratio. The exercise machine of this invention can provide for all of these alternatives.

The sliding linkage of this invention allows for a shorter movement of the traveling member on the slide rail to produce an equivalent amount of exercise movement to that of previous composite motion machines in which slide rails and sliders were provided on both the main frame and the user support. In this invention, apart from the scissoring linkage version, only one slide rail and slider or roller may be used, and the provision of a linkage secured to a fixed point on the frame or user support allows for a shorter travel to permit an equal degree of movement of the exercise arm and user support. Because the slide rail is shorter, expense is reduced. Also, because the slider or traveling member travels a shorter distance per repetition, there is less wear and fatigue on the bearings and rails, reducing maintenance fees and increasing component life.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 44:
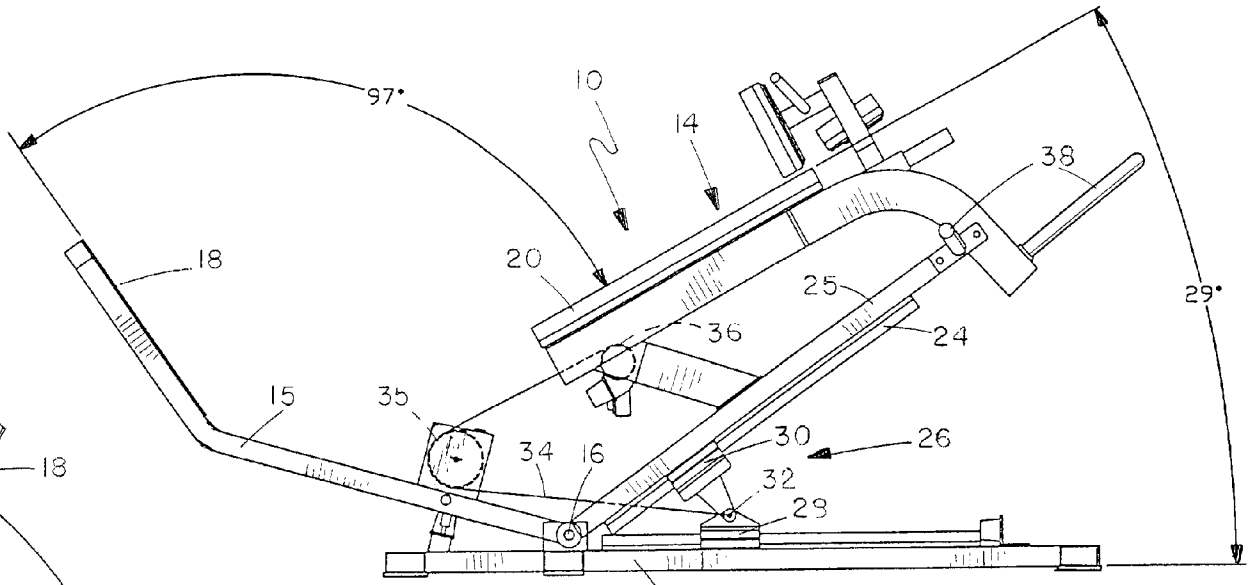
FIG. 44 PRIOR ART
FIG. 44 illustrates the prior art machine of FIG. 43 in a fully extended position.
Figure 43:
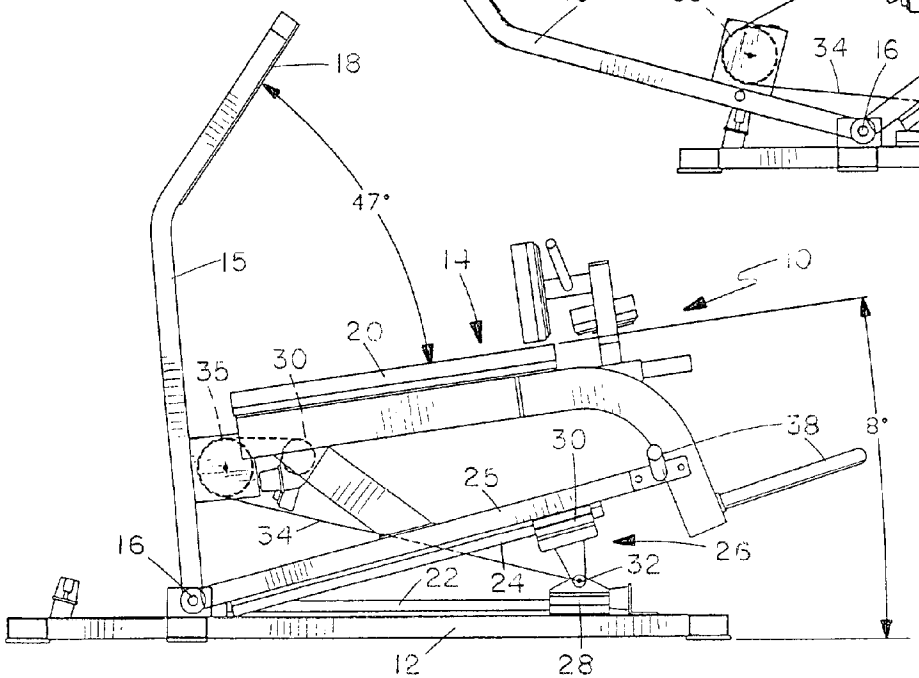
FIG. 43 PRIOR ART
FIG. 43 illustrates a prior art composite motion machine in a starting position.

FIGS. 43 and 44 illustrate a prior art composite motion machine 10 having a base or main frame 12, and a user support 14 and an exercise arm 15 both pivoted to the frame 12 at the same pivot 16. The machine is designed for performing leg press type exercises, and the exercise arm has a foot plate 18 for engagement by the feet of a user reclining on the seat pads 20 of the user support.

A first slide rail 22 is mounted to extend along the base or main frame 12 beneath the user support, while a second slide rail 24 is mounted on the lower member 25 of the user support facing the first slide rail 22. A truck 26 is slidably engaged with the first and second slide rails. Truck 26 has a first or bottom linear slide or bearing 28 slidably engaged on the first slide rail 22 and a second or top linear slide or bearing 30 slidably engaged on the second slide rail 24. The two slides or bearings are hinged together via hinge connection 32 to permit rotation of the top bearing relative to the bottom bearing as the machine moves from its starting position to its fully extended position.

The truck 26 is linked to the exercise arm 15 via a belt 34 which extends from the hinge 32, around a pulley 35 on the exercise arm, and then to a tie-off 36 on the user support 14. Additional exercise resistance is provided by weight plates which may be mounted on pin 38 on the user support.

The movement relationship between the exercise arm, user support, and truck or sliding linkage of the prior art exercise machine can be seen by comparison of FIGS. 43 and 44. As illustrated, both of the linear slides must travel substantially the entire length of the respective slide rails 22,24 as the exercise arm and user support are moved from the start position to the fully extended position.

FIGS. 1 to 6 illustrate a composite motion exercise machine 40 according to a first embodiment of the present invention, which has an improved sliding and pivotal linkage system between the frame, exercise arm, and user support. The machine 40 has a main frame 42, an exercise arm 44 pivotally mounted on the frame for rotation about pivot 45, a user support 46 pivotally attached to the frame, and a sliding and pivotal linkage system 48 linking the frame, exercise arm, and user support in the manner described below. The user support is attached via a pivot shaft co-linear with the exercise arm pivot axis, and the exercise arm and user support may alternatively be pivotally mounted on the same pivot shaft.

The machine 40 of FIGS. 1 to 6 is of the leg press type, and has a footplate 50 mounted adjacent the upper end of the exercise arm 44 facing the user support 46. However, it will be understood that the sliding and pivotal linkage system may alternatively be used on other machines having different exercise arm arrangements with other user engaging devices, such as handles, straps, or the like. The user support basically comprises a pair of spaced, parallel lower support bars 52 which are each pivoted at one end to the frame for rotation about pivot axis 45 via pivot sleeves 53 rotatably mounted on separate pivot shafts, and an upper support member 54 connected to the support bars 52 via rigid links or struts 55. A seat or back pad 56 is mounted on top of support member 54 for the user to recline on, and an adjustable shoulder pad 58 is secured to the support member at the rear end of back pad 56 via support frame 59. The shoulder pad holds the user in place and provides bracing for their shoulders when performing a leg press exercise. Hand grips 61 are mounted on the shoulder pad assembly to provide added comfort when performing the exercise.

Load receiving weight pegs 60 are mounted at the rear of the user support 46. A first, vertical end stop post or stand-off 62 at the rear end of the main frame holds the user support in the starting position of FIG. 1, by engaging the lower end 63 of the support member 54. A second outwardly projecting end stop post or stand-off 64 on the exercise arm engages a stop pad 65 on the front end of the user support in the starting position of FIG. 1. A stop pad 66 at the forward end of the frame acts to support exercise arm 44 when in the fully extended position of FIG. 2.

Figure 3:
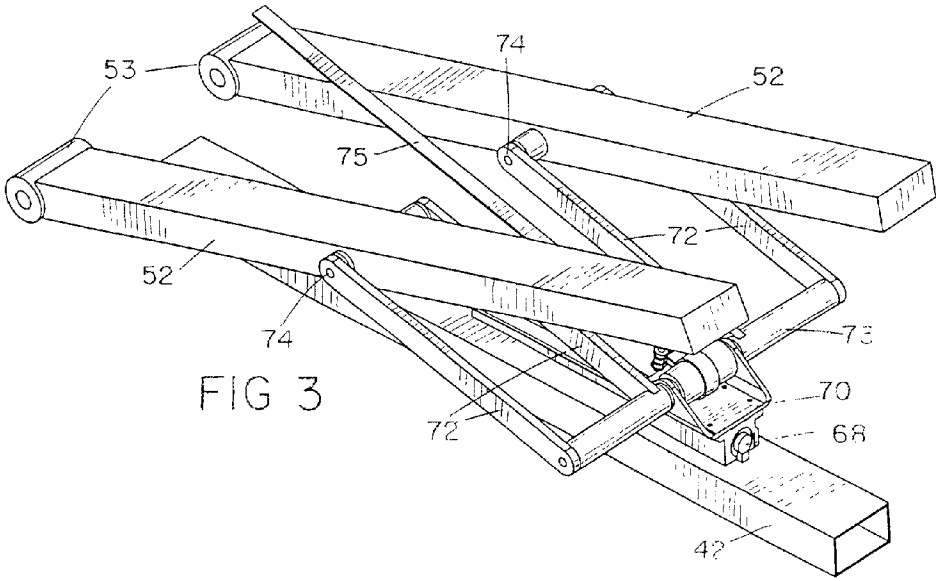
FIG. 3 is an enlarged perspective view of the slide and linkage assembly of the machine of FIGS. 1 and 2.
Figure 4:
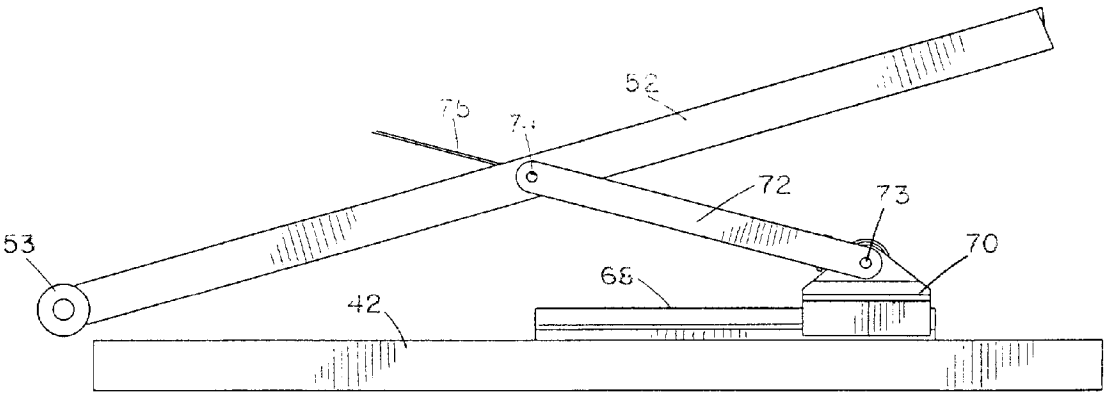
FIG. 4 is a side elevation view of the assembly of FIG. 3.
Figure 6:
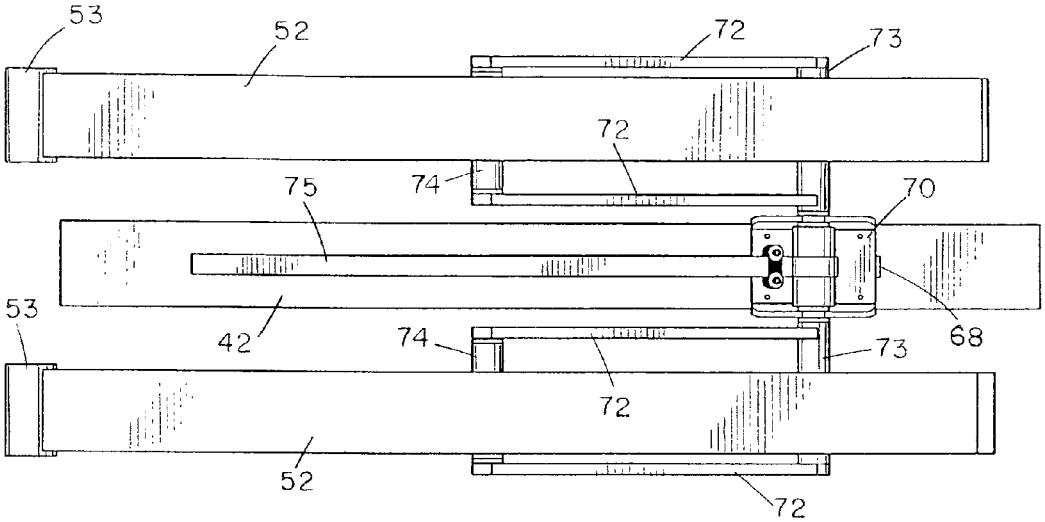
FIG. 6 is a top plan view of the assembly of FIGS. 3 to 5.

The pivotal and sliding linkage assembly between the main frame, user support, and exercise arm will now be described in more detail with reference to FIGS. 3 to 6. A slide rail 68 is mounted on the main frame or base 42 beneath the user support, and a slide or carriage 70 is slidably engaged on rail 68. A pair of generally U-shaped links or yokes 72 are pivoted at their centers to the slide 70 for rotation about pivot axis 73, and each end of the yokes 72 are pivoted via pivots 74 to the respective support bars 52, as best illustrated in FIG. 3. A belt 75 is connected between the exercise arm 44 and the slide 70, as indicated in FIGS. 1, 2 and 3.

Figures 1, 2:
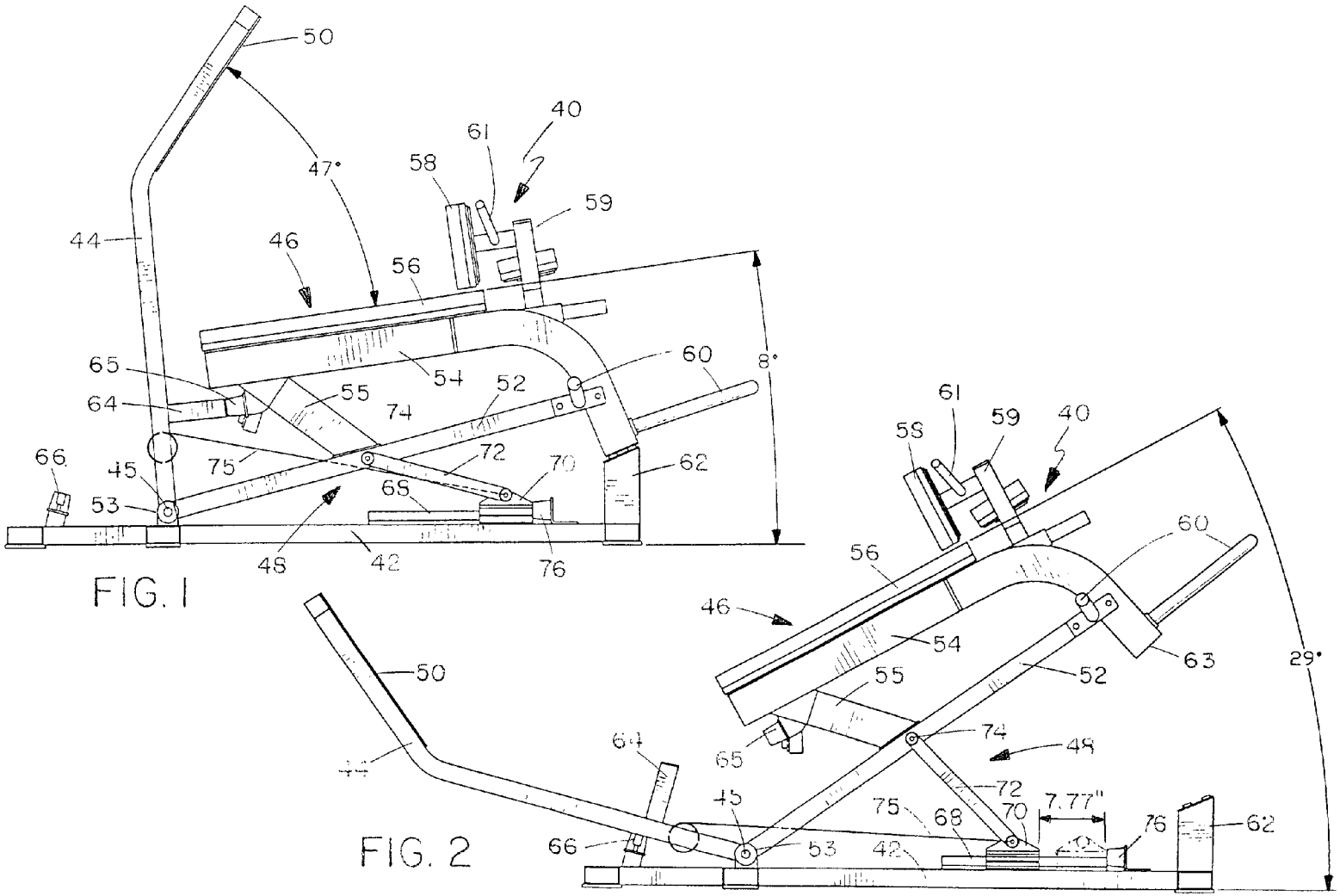
FIG. 1 is a side elevational view of a composite motion machine according to a first embodiment of the invention, showing the machine in a starting exercise position.
FIG. 2 is a side elevational view of the machine of FIG. 1, illustrating the fully extended position.
Figure 5:
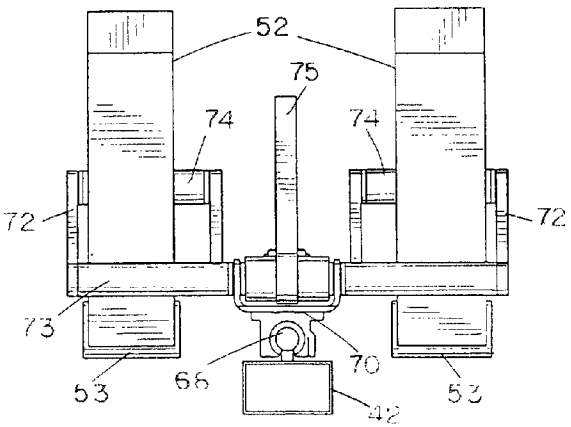
FIG. 5 is a rear view of the assembly of FIGS. 3 and 4.

FIG. 1 illustrates the machine with the exercise arm 44 in the starting or fully retracted position. In this position, slide or carriage 70 is at the rear end of the slide rail 68, and an end stop 76 at the end of the slide rail prevents the slide from falling off the rail. In order to perform the exercise, the user reclines on the back pad 56 with their shoulders against the shoulder pads 58, placing their feet against the foot plate 50. They then push the foot plate forwards, forcing the exercise arm 44 to rotate about pivot 45. At the same time, the connecting linkage or belt 75 which connects the exercise arm to the slide 70 will pull the slide along the slide rail, causing the pivotal link 72 to lift the user support via its pivotal connection to the lower supports 52 of the user support, as indicated in FIG. 2. This forces the user support to also pivot about its pivotal attachment 45 to the main frame. The load, supplied by weight plates (not illustrated) added to the weight peg or pegs 60, travels with the user support to provide a resistive force to movement of the exercise arm.

The user support pad 56 is at an angle of 8 degrees to the horizontal in the starting position of FIG. 1, and moves to an orientation of 29 degrees (i.e. through an angle of 21 degrees) into the fully extended position of FIG. 2. At the same time, the exercise arm moves from an angle of 55 degrees to the horizontal in FIG. 1, to an angle of 125 degrees in the fully extended position of FIG. 2 (i.e. moving through an overall angular distance of 70 degrees). Thus, with the pivotal linkage of FIGS. 1 to 6, while the exercise arm and the user support travel in the same direction during an exercise movement, they do so at different rates and grow further apart during the movement.

In the prior art machine of FIGS. 43 and 44, an equivalent amount of exercise movement is achieved. However, the required movement of the carriage in the prior art machine in order to accommodate the complete exercise movement is much greater than with the pivotal linkage arrangement of FIGS. 1 to 6. By comparing FIGS. 1 and 2 and FIGS. 43 and 44, it can be seen that the carriage 70 moves a much shorter distance along slide rail 68 than the carriage or slider 28 moves along rail 22 in order to achieve the same amount of exercise motion. In fact, slide 70 travels less than half of the distance of slide 28 in order to achieve the same amount of motion. Thus, a shorter slide rail can be used with this invention, reducing cost. Also, because the slide moves a shorter distance for each exercise repetition, there is less wear and fatigue to the slide bearings and rail, which reduces maintenance and increases component life. Another advantage of this embodiment of the invention is that it uses fewer rails and bearings than the prior art arrangement of FIGS. 43 and 44, which uses two sets of slide rails and slides. This further reduces both initial and maintenance costs.

Another difference between the embodiment of FIGS. 1 to 6 and the prior art machine of FIGS. 43 and 44 is the manner in which the slide is connected to the exercise arm. In FIGS. 43 and 44, the truck 26 is connected to the exercise arm via a belt 34 which extends over a pulley 35 on the exercise arm and on to a tie-off 36 on the user support at its other end. In contrast, in the pivotal linkage of FIGS. 1 to 6, cable 75 connects directly to the slide at one end and to the exercise arm at the other end, reducing the number of components and the length of the belt, further reducing cost and required maintenance. If the belt 34 of the prior art machine was connected in this way, it would not be able to achieve the same degree of movement of the user support when the exercise arm is fully extended. The belt 34 must be routed over a pulley on the exercise arm and back to the user support in order to achieve this motion, because of the way in which the pivotal linkage is arranged.

Figure 7:
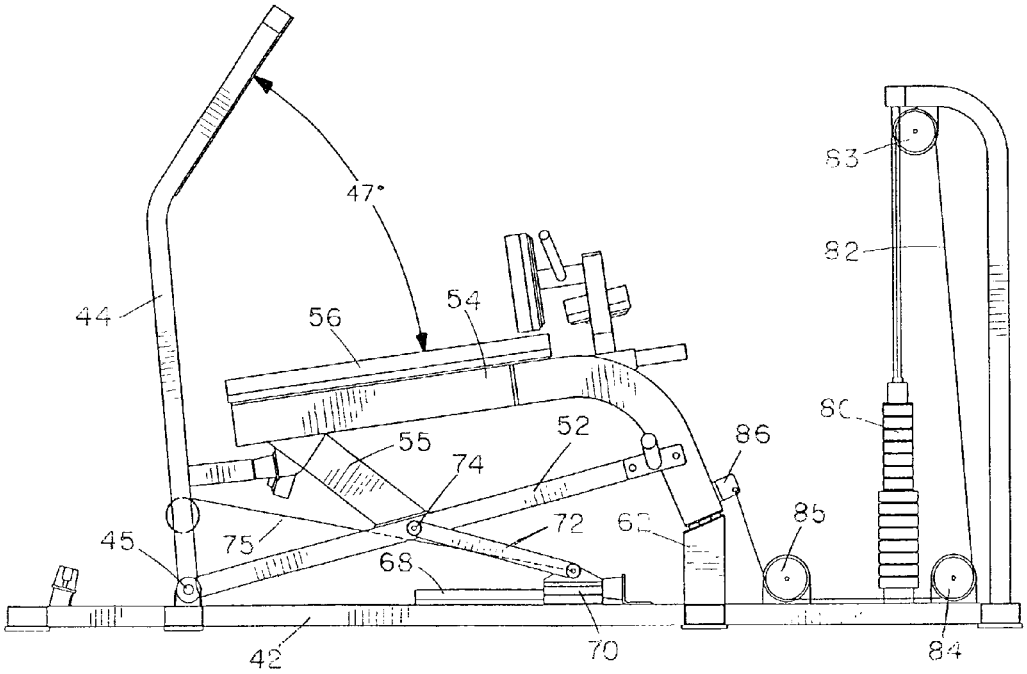
FIG. 7 is a side elevational view of a composite motion machine according to a second embodiment of the invention, showing the machine in a starting exercise position.
Figure 8:
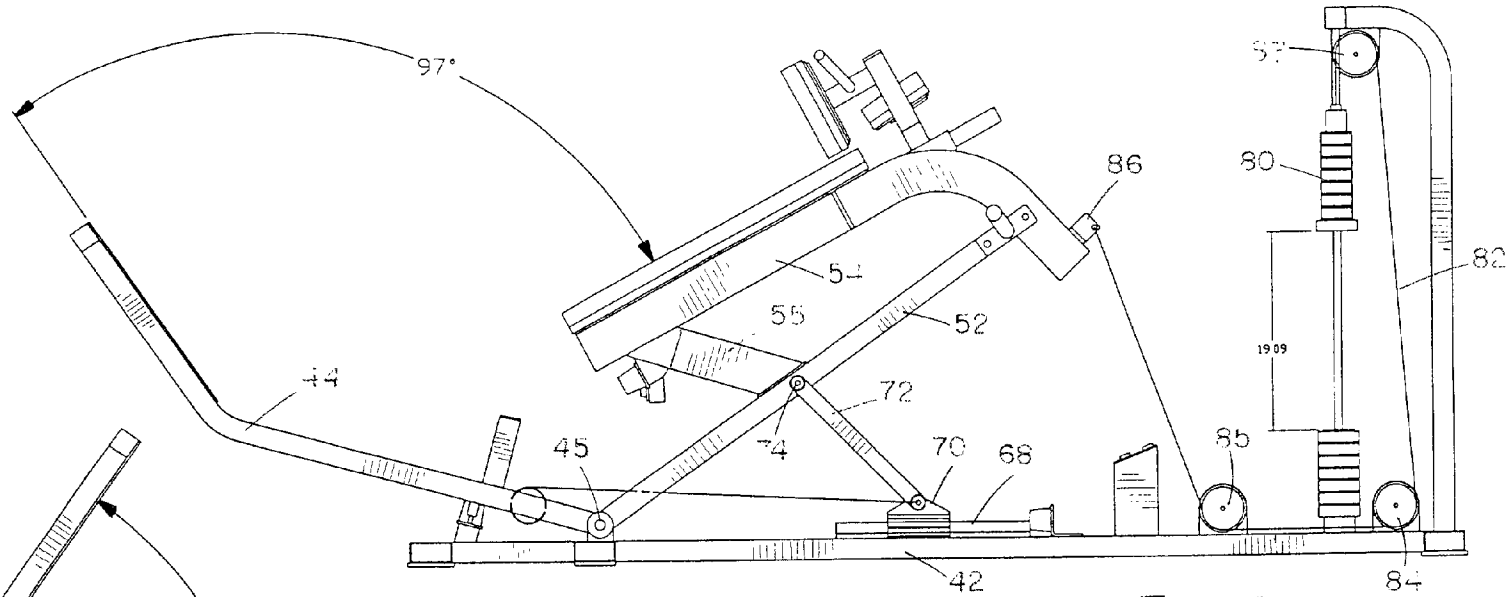
FIG. 8 is a side elevational view of the machine of FIG. 7, illustrating the fully extended position.

In the embodiment of FIGS. 1 to 6, load is provided by the weight of the user as well as the weight of the user support, augmented by weight plates placed on the pin 60 on the user support. However, the additional load or exercise resistance may be provided in many different ways, as will be understood by those skilled in the field, such as weight plates, a weight stack, air or hydraulic resistance, electric or magnetic resistance, tension springs, bands or rods, or any other form of exercise resistance common in the field. The additional resistance may be connected to any of the moving parts, such as the exercise arm, the user support, or the sliding pivotal linkage system. FIGS. 7 and 8 illustrate a modification of the leg press machine of FIGS. 1 to 6 with a different type of additional resistance. The machine of FIGS. 7 and 8 is otherwise identical to that of FIGS. 1 to 6, and like reference numerals have been used for like parts as appropriate.

Figure 9:
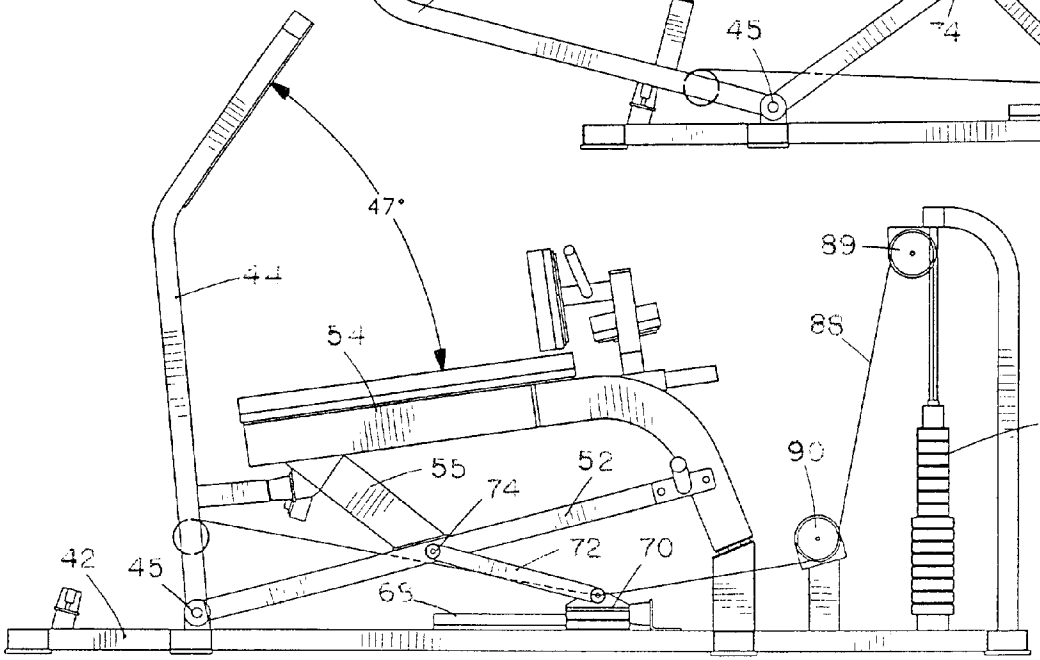
FIG. 9 is a side elevational view of the starting position of a composite motion machine similar to that of FIGS. 7 and 8, but with a different attachment location for the load.

In the machine of FIGS. 7 and 8, a weight stack 80 is linked to the user support, either in place of or in addition to weight plates on a peg 60 to provide additional resistance. Cable or belt 82 is attached to the weight stack at the rear end of the frame, and runs around pulleys 83,84, and 85 to connect at anchor 86 to the rear of the user support. FIG. 9 illustrates a modification in which a weight stack 87 is attached to the slide 70 instead of the user support. In this alternative, cable 88 extends from the weight stack 87 around pulleys 89 and 90 before connecting to slide 70. The weight stack 80 in FIGS. 7 and 8 has greater travel, and therefore generates more resistance. The amount of required resistance can vary based on the type of exercise being performed. Weaker muscle groups, which use less resistance, could be better suited for the weight stack set up of FIG. 9, while stronger muscle groups would benefit from the increased resistance of FIGS. 7 and 8.

Figures 10, 11, 12:
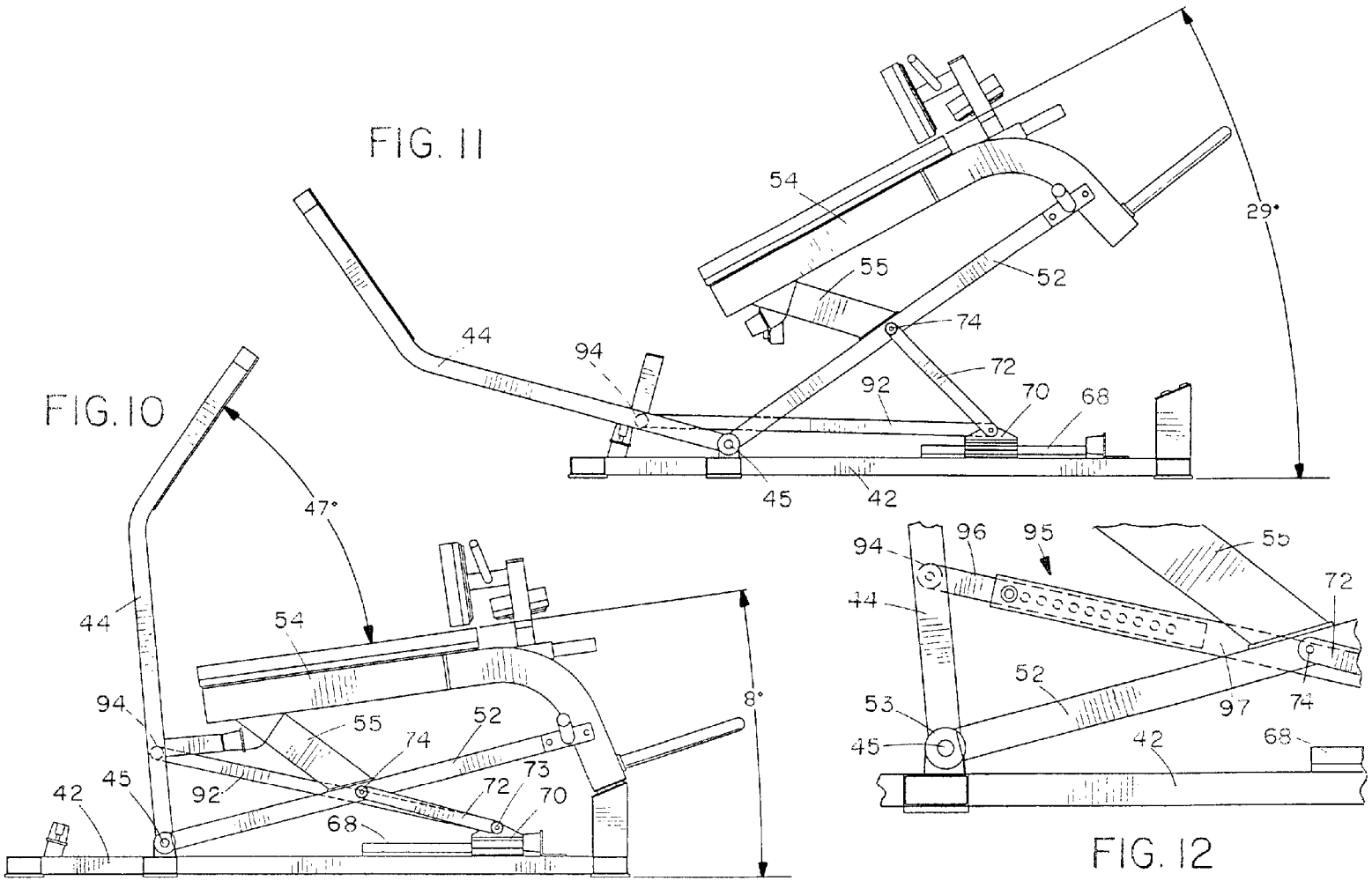
FIG. 10 is a side elevational view of a composite motion machine according to a third embodiment of the invention, showing the machine in a starting exercise position.
FIG. 11 is a side elevational view of the machine of FIG. 10, illustrating the fully extended position.
FIG. 12 is an enlarged view of the connecting link of the machine of FIGS. 10 and 11, illustrating an optional adjustable length link.

FIGS. 10 to 12 illustrate a leg press machine similar to that of FIGS. 1 to 6, but with a modified linkage between the slide and exercise arm. The machine of FIGS. 10 to 12 is otherwise identical to that of FIGS. 1 to 6, and like reference numerals have been used for like parts as appropriate. In this embodiment, instead of a belt 75 linking slide 70 to the exercise arm 44, a straight link arm 92 connects the slide 70 to the exercise arm 44. Arm 92 is pivoted at one end to the slide pivot 73, and is pivotally connected to the arm 44 at pivot 94. The straight link arm 92 performs exactly the same function as the belt 75 of the first embodiment, and the exercise motion is the same, as can be seen from the start position of FIG. 10 and the fully extended position of FIG. 11. FIG. 12 illustrates a modification in which the non-extendible link arm 92 is replaced with an extendible, telescopic link arm 95 in which a first part 96 is telescopically engaged in a second part 97 of the arm. The overall length of arm 95 can be adjusted by changing the extension of part 96 out of part 97. This can be used to adjust the starting orientation of the exercise arm 44 relative to the user support 46.

Figure 13:
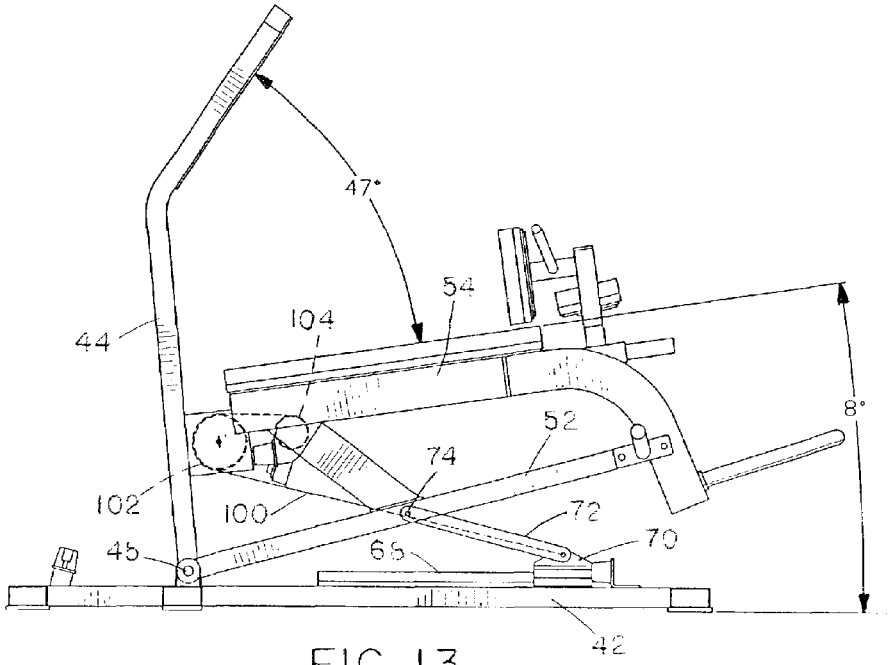
FIG. 13 is a side elevational view of a composite motion machine according to a fourth embodiment of the invention, showing the machine in a starting exercise position.
Figure 14:
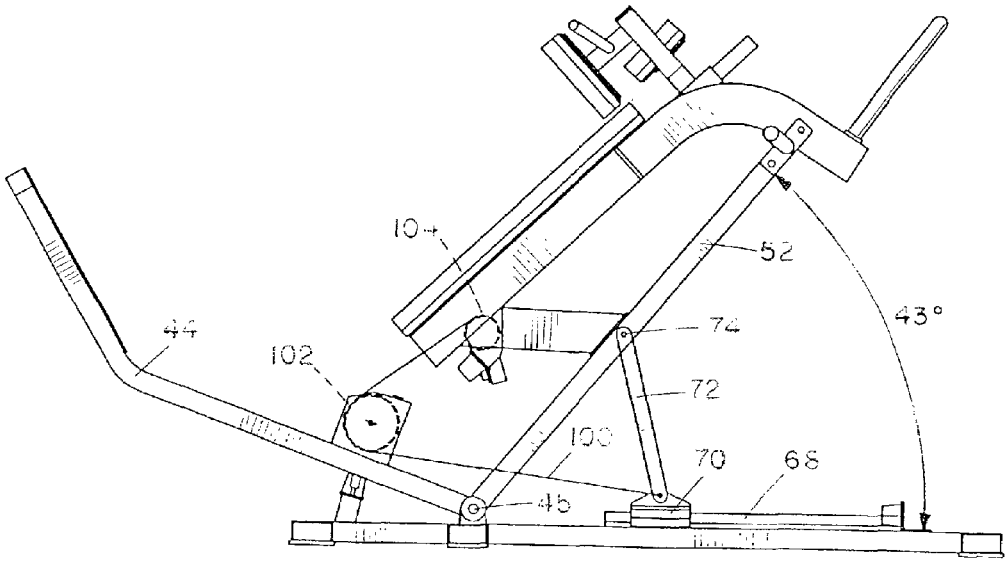
FIG. 14 is a side elevational view of the machine of FIG. 13, illustrating the fully extended position.

FIGS. 13 and 14 illustrates another modification of the leg press machine of FIGS. 1 to 6 in which the user support travels a greater distance than the user support of the first embodiment, by means of a different linkage between the slide and the exercise arm. This embodiment is otherwise identical to that of FIGS. 1 to 6, and like reference numerals have been used for like parts as appropriate.

In FIGS. 13 and 14, rather than a simple cable or belt extending between the slide and exercise arm 44, a belt 100 extends from the slide 70, around a pulley 102 on the exercise arm 44, and then terminates at a tie-off 104 at the forward end of the user support 46. This is similar to the prior art linkage of FIGS. 43 and 44. However, with the sliding linkage system 48 of this invention, a greater ratio of user support travel to exercise arm travel is achieved. When the user places their feet against foot plate 50 and pushes, the user support will be lifted by the movement of the slide 70 as well as the belt linkage from the exercise arm directly to the user support. Thus, in the fully extended position of the exercise arm 44, as indicated in FIG. 1, the arm 44 is at the same angle as in FIG. 2, but the user support 46 is at an angle of 43 degrees, and therefore travels through an angle of 35 degrees, as compared to the 21 degrees traveled by the user support of the first embodiment.

The arrangement of FIGS. 13 and 14 increases the resistance-felt to load-required ratio over that of the previous embodiments, so that fewer weight plates or a smaller weight stack would be required to achieve equivalent resistance. Also, since the amount of movement of the user support is increased without increasing the movement of the slide, manufacturing costs and maintenance requirements will be decreased, and the lifetime of the parts will be increased.

Figure 16:
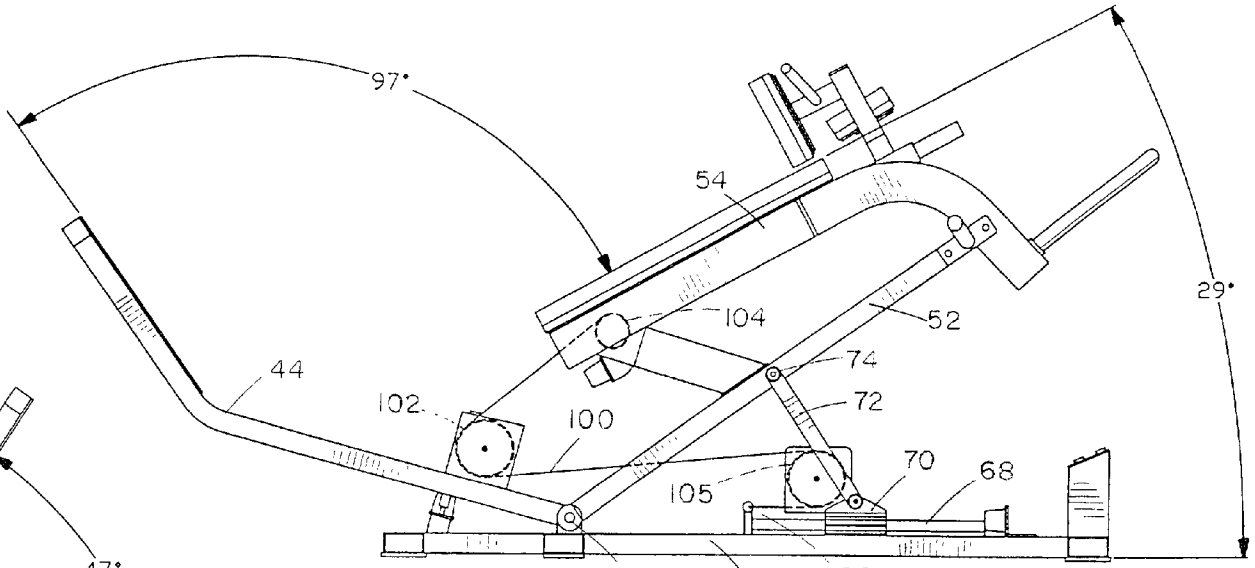
FIG. 16 is a side elevational view of the machine of FIG. 15, illustrating the fully extended position.
Figure 15:
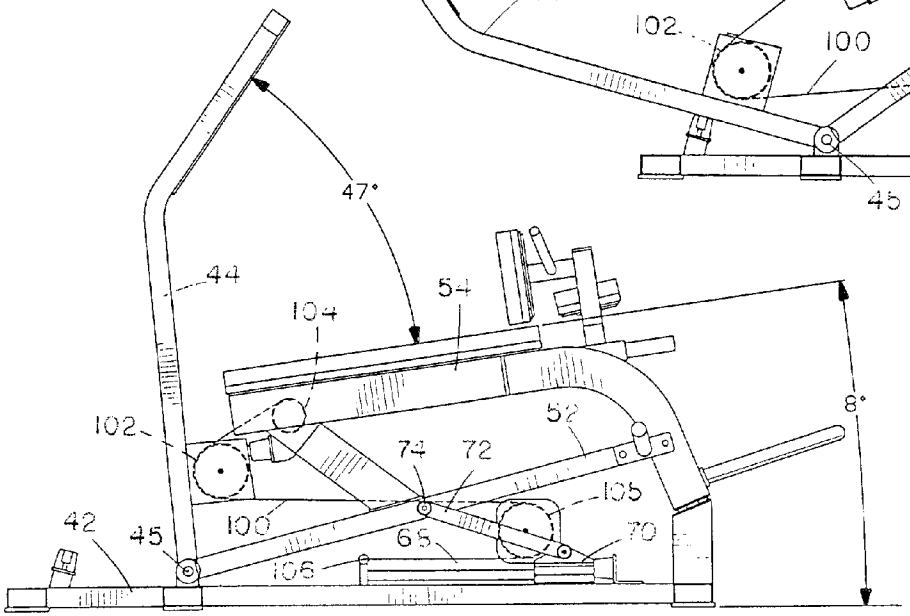
FIG. 15 is a side elevational view of a composite motion machine according to a fifth embodiment of the invention, showing the machine in a starting exercise position.

FIGS. 15 and 16 illustrate a modification of the linkage of FIGS. 13 and 14. In this embodiment, belt 100 still extends from tie-off 104 on the user support over pulley 102 on the exercise arm to the slide 70. However, rather than a simple tie off at the slide 70, as in FIGS. 13 and 14, the belt 100 extends over pulley 105 on the slide 70 and attaches to the main frame 42 at anchor or tie-off 106. This will reduce the travel of the user support 46 to the same degrees as the embodiment of FIGS. 1 to 6.

Figure 18:
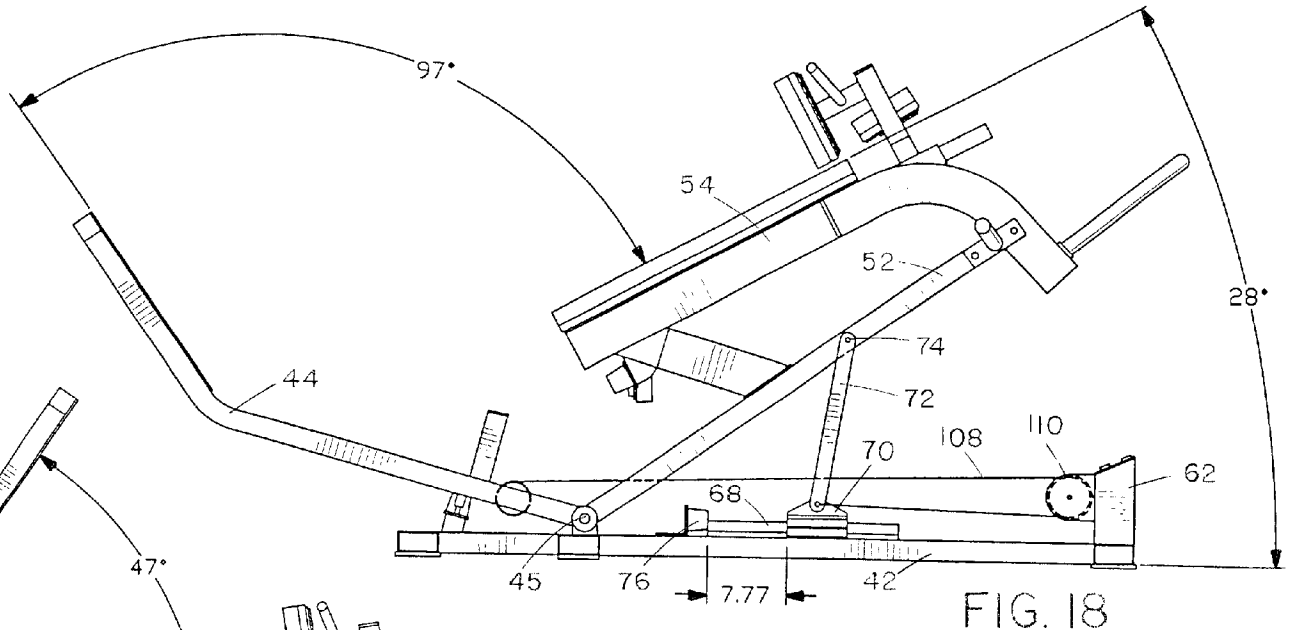
FIG. 18 is a side elevational view of the machine of FIG. 17, illustrating the fully extended position.
Figure 17:
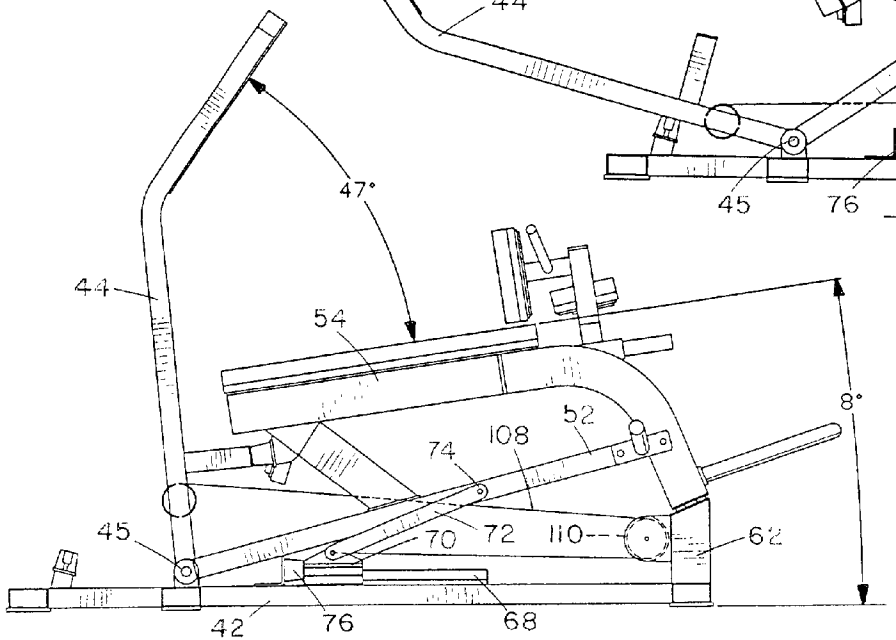
FIG. 17 is a side elevational view of a composite motion machine according to a sixth embodiment of the invention, showing the machine in a starting exercise position.

FIGS. 17 and 18 illustrate another modified connecting linkage from the slide 70 to the exercise arm 44. The machine of FIGS. 17 and 18 is otherwise identical to that of the previous embodiments and like reference numerals have been used for like parts as appropriate. In this embodiment, the slide 70 moves rearward, rather than forward, during the exercise movement. A cable or belt 108 extends from slide 70 rearwards around a pulley 110 mounted on the end stop post 62, and then attaches to the exercise arm 44 at its forward end. This version achieves exactly the same angular motion of the exercise arm and user support between the start position of FIG. 17 and the fully extended position of FIG. 18 as the first embodiment, but with the slide moving in the opposite direction. The distance moved by the slide 70 will be shorter than in FIGS. 1 and 2, further reducing the required slide rail length and maintenance costs.

Figure 20:
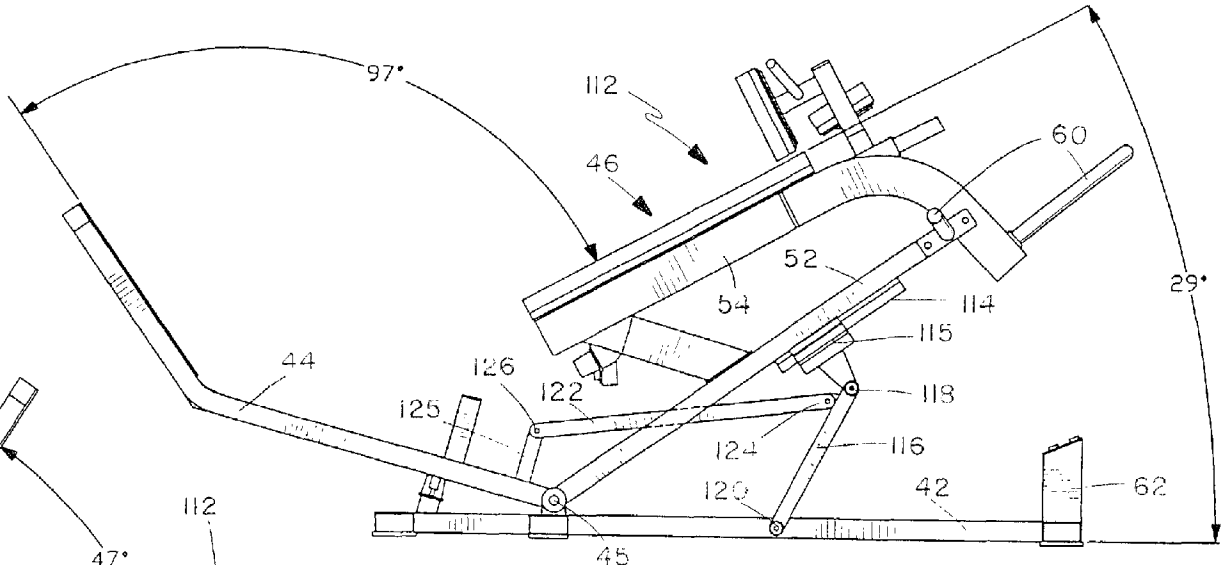
FIG. 20 is a side elevational view of the machine of FIG. 19, illustrating the fully extended position.
Figure 19:
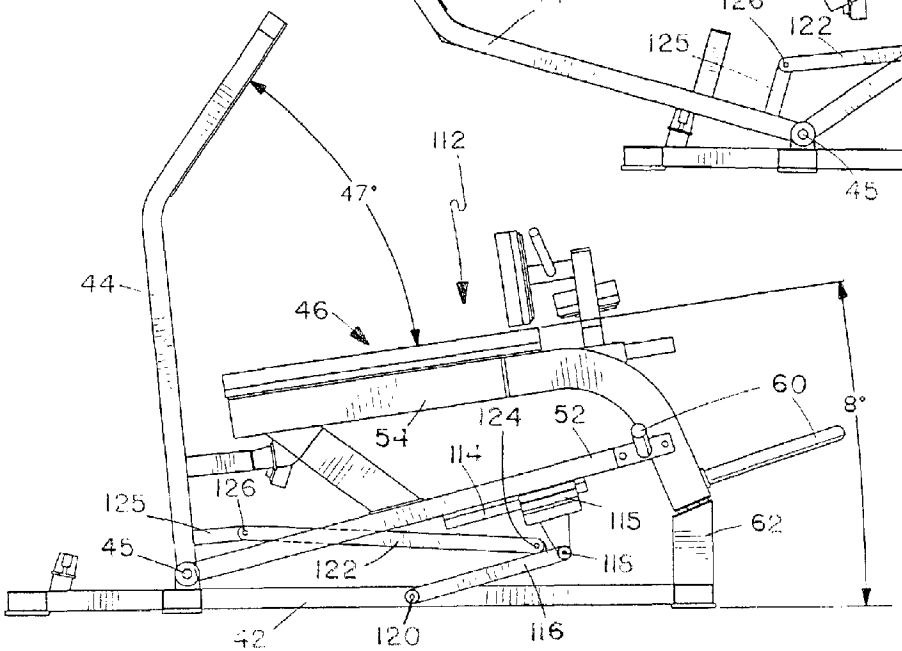
FIG. 19 is a side elevational view of a composite motion machine according to a seventh embodiment of the invention, showing the machine in a starting exercise position.

FIGS. 19 and 20 illustrate a modified, leg press exercise machine 112 in which the slide rail is provided on the user support rather than the main frame. Although the sliding linkage system is modified in this embodiment, the other components of the exercise machine are equivalent to components used in FIGS. 1 to 6, and like reference numerals are used for like parts as appropriate.

In FIGS. 19 and 20, a slide rail 114 is mounted on the lower support bar or bars 52 of the user support, and a slide or carriage 115 is slidably mounted on rail 114. A pivotal link 116 is pivoted at one end to the slide 115 via pivot 118, and is pivoted at the opposite end to the main frame or base 42 via pivot 120. A second pivotal link 122 has a first end pivotally connected to the first pivotal link 116 via pivot 124, and a second end pivotally connected to a standoff 125 on the exercise arm via pivot 126.

As can be seen by comparison of the start position of FIG. 19 and the fully extended position of FIG. 20, this embodiment generates the same travel ratios for the user support and exercise arm as the embodiment of FIGS. 1 to 6, but requires very little travel by the slide, further reducing the length of the slide rail and the maintenance requirements for the sliding, pivotal linkage assembly.

Figure 21:
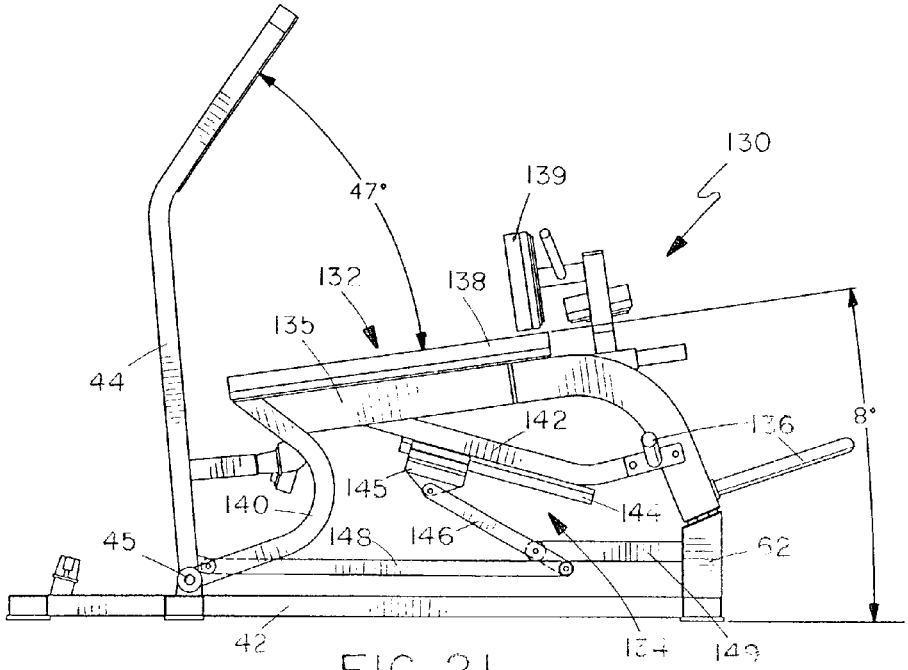
FIG. 21 is a side elevational view of a composite motion machine according to an eighth embodiment of the invention, showing the machine in a starting exercise position.
Figure 22:
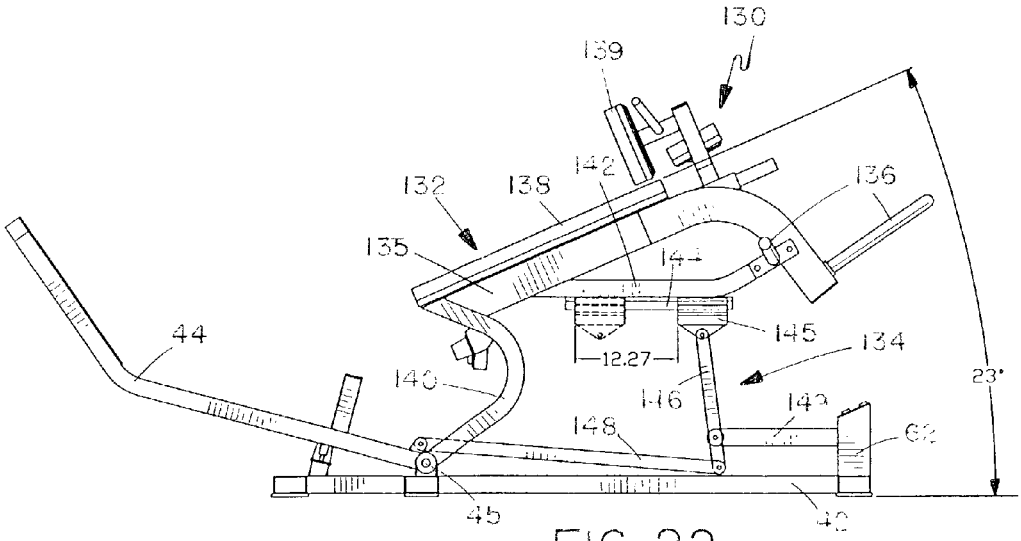
FIG. 22 is a side elevational view of the machine of FIG. 21, illustrating the fully extended position.

FIGS. 21 and 22 illustrate a leg press machine 130 according to another embodiment of the invention, which is similar in some respects to the embodiment of FIGS. 19 and 20 but generates less travel of the user support relative to the travel of the exercise arm. Some parts of the machine 130 are identical to those of previous embodiments, and like reference numerals have been used for like parts as appropriate. Thus, the machine 130 has a main frame 42 and exercise arm 44 identical to the previous embodiments. However, a modified user support 132 is pivoted to the frame 42 about the same pivot axis 45 as the exercise arm 44, and the user support 132, frame 42, and exercise arm 44 are linked via a modified sliding pivotal linkage system 134.

The user support 132 has a first support strut 135 having a rearward, downwardly directed portion on which weight pegs 136 are located and which rests on the same end stop post 62 as the previous embodiments when the machine is in the starting position of FIG. 21. As in the previous embodiments, a back pad 138 is mounted on top of strut 135 and shoulder pads 139 are provided for supporting the user's shoulders when performing leg press exercises. A curved connecting strut 140 at the forward end of strut 135 curves first rearwardly and then forward, with its forward end pivoted to the frame at pivot 45. A slide support strut 142 extends beneath the upper strut 135.

The pivotal linkage system basically comprises a downwardly facing slide rail 144 on the support strut 142, a slide 145 slidably mounted on rail 144, and a multiple linkage arm assembly connecting the slide 145 to the frame and to the exercise arm. The multiple linkage arm assembly comprises a first link arm 146 having an upper end pivoted to slide 145 and a lower end, a second link arm 148 pivoted to the lower end of arm 146 at one end and to the exercise arm 44 at its opposite end, and a third link arm 149 pivoted at one end to the first link 146 at a location spaced between its ends and secured to the end stop post 62 at its opposite end.

The exercise machine of FIGS. 21 and 22 uses a modified pivotal linkage in order to generate less travel of the user support relative to the travel of the exercise arm than the previous embodiments. Thus, as illustrated in FIG. 22, the user support travels through an angle of only 15 degrees between the start position and the fully extended position, rather than 21 degrees as in the first embodiment.

Figure 23:
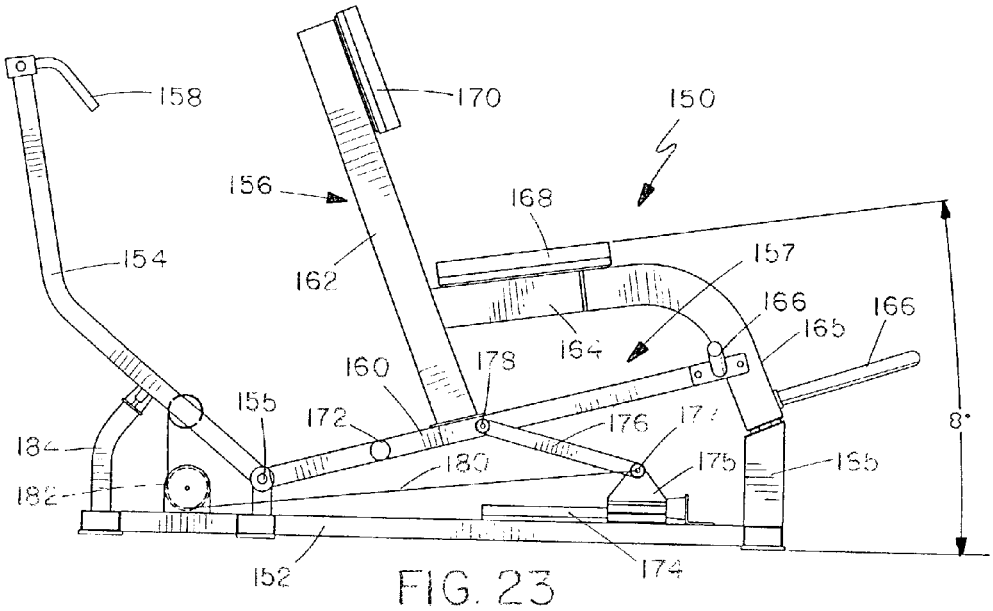
FIG. 23 is a side elevational view of a composite motion machine according to a ninth embodiment of the invention, showing the machine in a starting exercise position.
Figure 24:
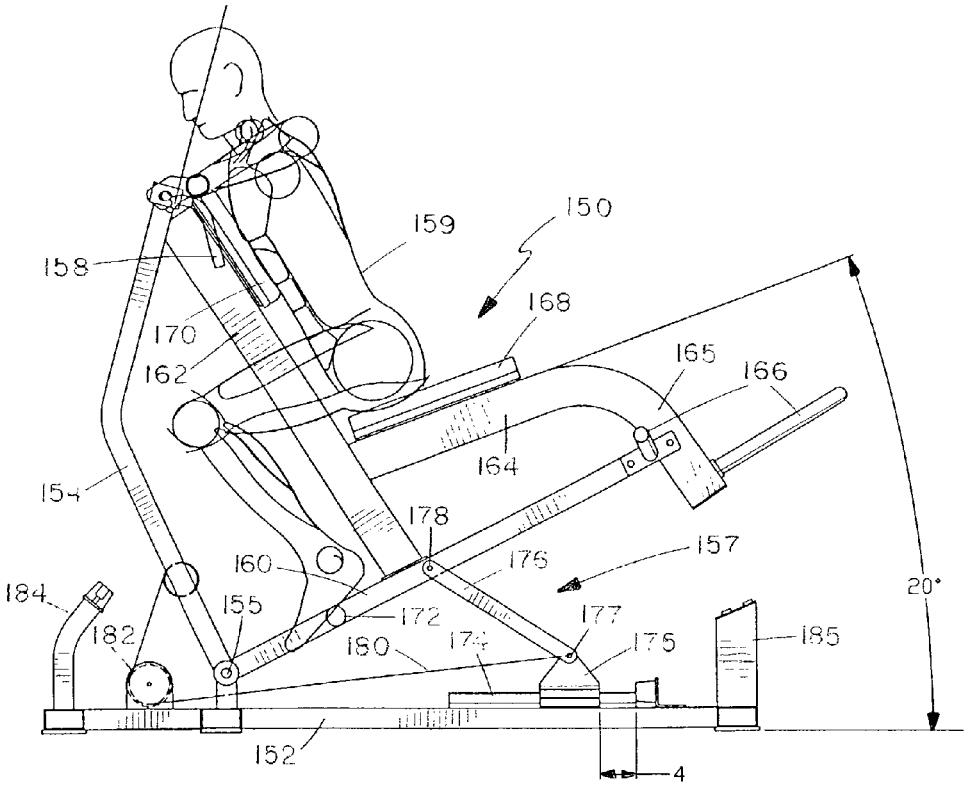
FIG. 24 is a side elevational view of the machine of FIG. 23, illustrating the fully extended position.

FIGS. 23 and 24 illustrate an upper body exercise machine 150 according to another embodiment of the invention. The machine has a main frame 152, an exercise arm 154 pivotally attached to the main frame at its lower end via pivot 155, and a user support 156 which is also pivotally attached to the main frame via a pivot shaft co-linear with pivot 155. It will be understood that the exercise arm and user support may have the same pivot shaft or separate but co-linear pivot shafts. A sliding pivotal linkage assembly 157 is provided between the user support, main frame and exercise arm, as will be described in more detail below.

In this embodiment, the exercise arm 154 has handles 158 at its upper end for gripping by a user 159 when performing exercise. The user support comprises a base strut 160 extending rearwardly from pivot 155, a generally upright strut 162 extending upwardly from base strut 160 at a location spaced between its ends, and a seat support strut 164 extending forward from upright strut 162 at a location spaced above the base strut 160. Seat support strut 164 has a downwardly directed, rear portion 165 having weight plate support pegs 166 adjacent its lower end. The base strut 160 is secured to the downwardly directed portion 165 at its rear end. The seat support strut 164 has a seat pad 168 for the user 159 to sit on, and the upright strut 162 has a chest support pad 170 adjacent its upper end to hold the user in place and provide bracing for their upper body when performing an exercise, as generally illustrated in FIG. 24. Footrests 172 are mounted on the base support strut 160 to provide added comfort to the user when performing exercise.

The sliding pivotal linkage assembly basically comprises a slide rail 174 mounted on the main frame 152, a slide or carriage 175 slidably mounted on rail 174, and a pivotal link 176 pivoted at one end to the slide 175 via pivot 177 and to the base support strut 160 of the user support at the opposite end via pivot 178. The assembly also has a connecting belt or linkage 180 extending from slide 175 around a pulley 182 on the frame 152 and terminating at the exercise arm 154 at its second end. Front and rear support posts 184,185 on the main frame 152 support the exercise arm 154 and the user support 156, respectively, when in the starting position of FIG. 23.

In order to perform the exercise, a user 159 sits on the seat pad 168 with their feet on footrests 172, facing forward, and grabs the handgrips 158, with the machine in the starting position of FIG. 23. They then pull the exercise arm 154 towards them. As the exercise arm rotates in a clockwise direction about its pivot 155, the belt 180 will pull the slide 175 forwards along the slide rail 174. This forces the link 176 to pivot about its connection to both the slide and the user support, which in turn lifts the user support, forcing it to rotate in an anti-clockwise direction about its pivotal connection 155 to the frame. The load, supplied by weight plates added to the weight pegs 166, travels with the user support to provide a resistive force to movement of the exercise arm, in addition to the weight of the user and the user support itself. In this embodiment of the invention, the exercise arm and user support travel in different directions towards one another and grow closer together during the exercise movement.

FIGS. 23 and 24 depict the total movement of the exercise arm and of the user support from the start to the finish of an exercise movement. As illustrated, the slide 175 moves only a short distance along slide rail 174 as the exercise arm and user support move from the start to the finish position. The user support travels through an angle of around 12 degrees from the start to the finish position, while the exercise arm travels through an angle of around 25 degrees.

Figure 25:
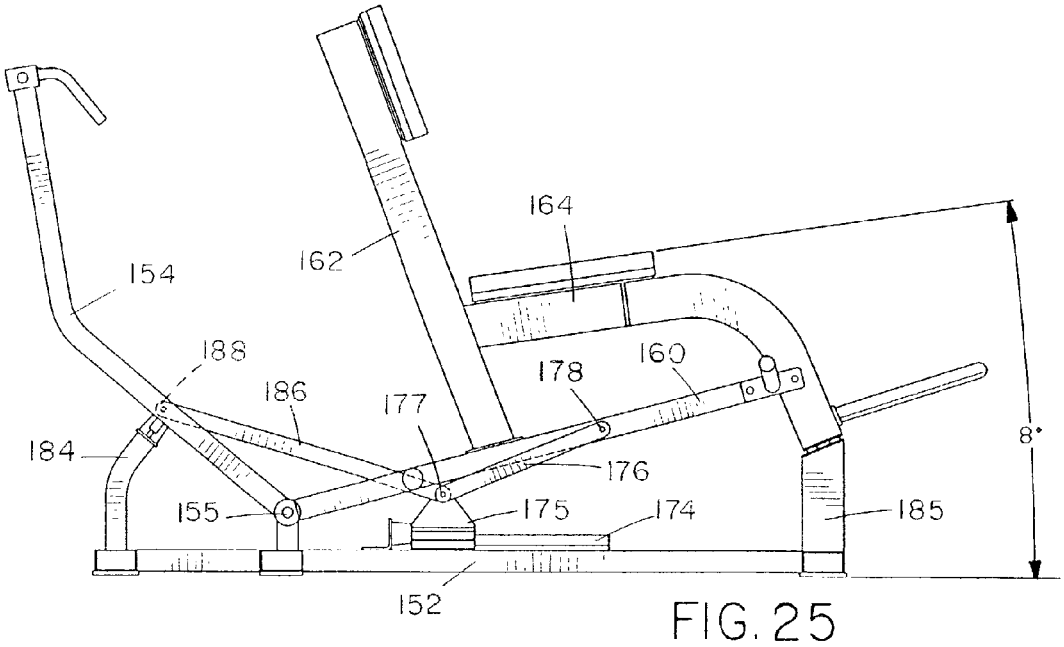
FIG. 25 is a side elevational view of a composite motion machine according to a tenth embodiment of the invention, showing the machine in a starting exercise position.
Figure 26:
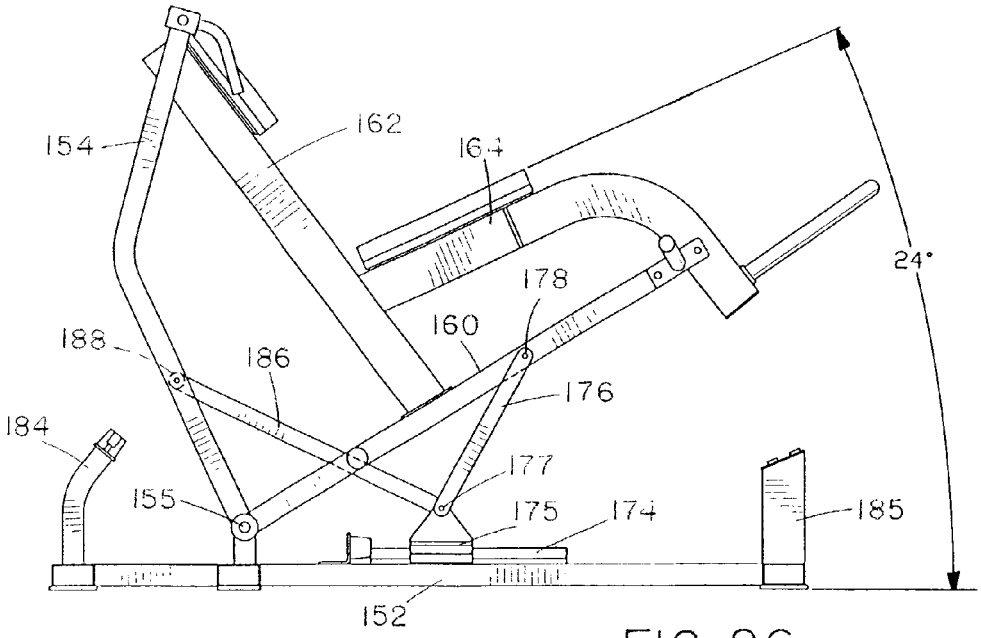
FIG. 26 is a side elevational view of the machine of FIG. 25, illustrating the fully extended position.

FIGS. 25 and 26 illustrate a modification of the upper body machine of FIGS. 23 and 24. In this embodiment, the belt 180 of the previous embodiment is replaced with a link arm. However, other components of this machine are identical to those of the previous embodiment, and like reference numerals have been used for like parts as appropriate. In this machine, a second connecting link 186 is pivoted to the slide 175 at pivot 177, and to the exercise arm at pivot 188.

In this embodiment, the first link 176 and the second connecting link 186 pivot about the same pivot axis 177 on the slide 175. When the exercise arm is pulled rearward by the user, from the position illustrated in FIG. 25 to the end position of FIG. 26, the slide is pushed rearward along the rail and the first connecting link 176 forces the user support and load upwards. On this version, the user support travels through an increased angle relative to the travel of the previous embodiment, moving through an angle of 16 degrees between the start position of FIG. 25 and the end position of FIG. 26. Thus, the resistance would be increased for the same load on the user support.

Figure 28:
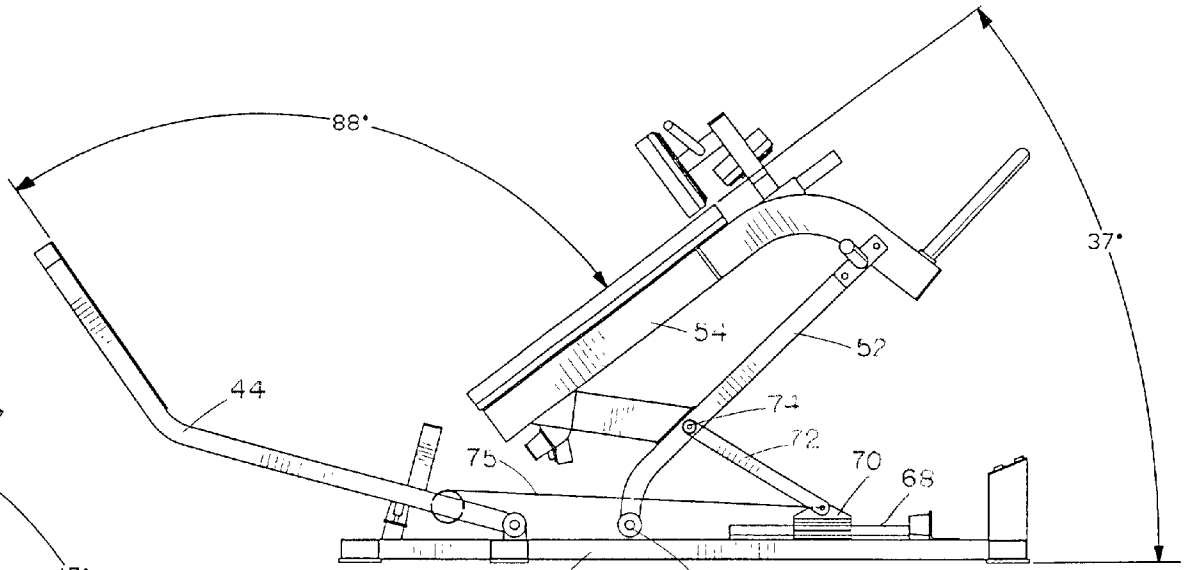
FIG. 28 is a side elevational view of the machine of FIG. 27, illustrating the fully extended position.
Figure 27:
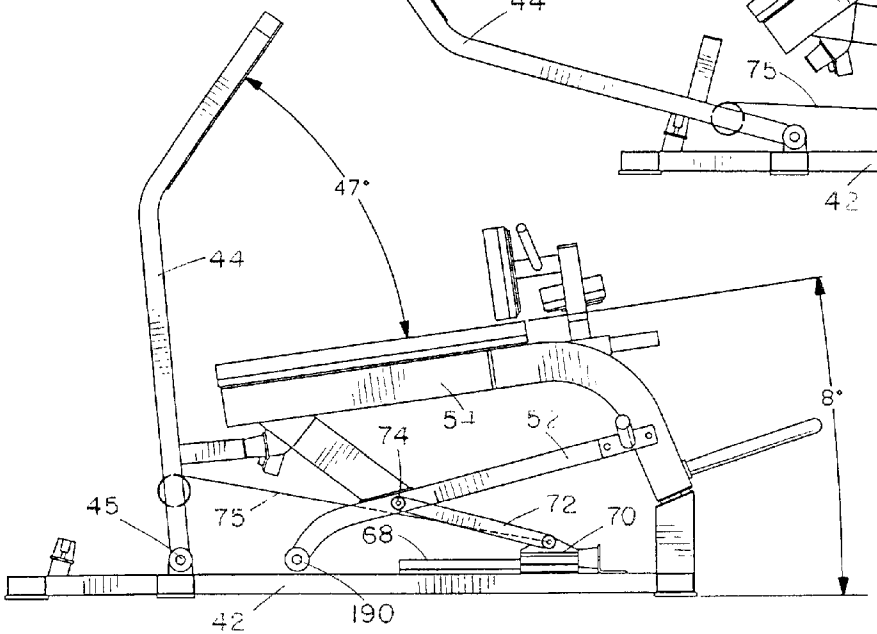
FIG. 27 is a side elevational view of a composite motion machine according to an eleventh embodiment of the invention, showing the machine in a starting exercise position.

FIGS. 27 and 28 illustrate another modification of the leg press machine of FIGS. 1 to 6. In this embodiment, unlike the embodiments of FIGS. 1 to 20, the user support and exercise arm do not pivot about a common axis. However, the components of the machine of FIGS. 27 and 28 are otherwise identical to those of FIGS. 1 and 2, and like reference numerals are used for like parts as appropriate.

As in the first embodiment, the exercise arm 44 of FIGS. 27 and 28 pivots on the frame 42 about pivot axis 45. However, the lower strut or struts 52 of the user support are pivotally connected to the frame at pivot axis 190, spaced rearwardly from the exercise arm pivot axis 45. In this arrangement, the user support 46 pivots through an angle of 29 degrees between the start position of FIG. 27 and the fully extended position of FIG. 28, while the exercise arm pivots through an angle of 70 degrees. Thus, the user support moves through a greater angle relative to the exercise arm in this embodiment, and the resistance will be increased. At the same time, the slide 70 travels through a very short distance between the start position of FIG. 27 and the end position of FIG. 28.

Figure 29:
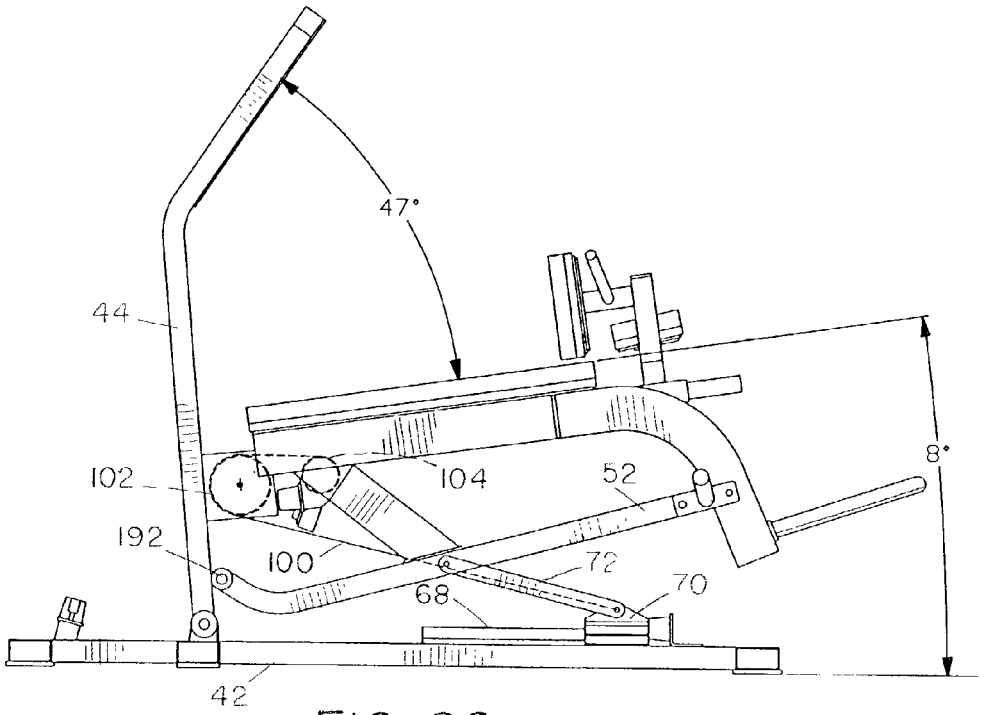
FIG. 29 is a side elevational view of a composite motion machine according to a twelfth embodiment of the invention, showing the machine in a starting exercise position.
Figure 30:
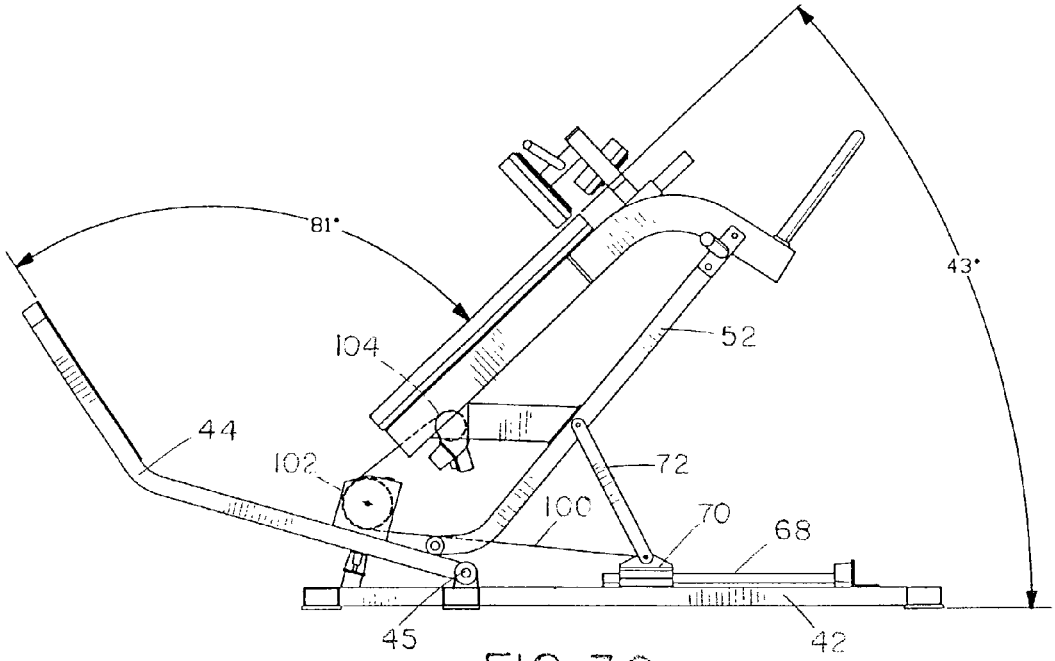
FIG. 30 is a side elevational view of the machine of FIG. 29, illustrating the fully extended position.

FIGS. 29 and 30 illustrate another modified pivot arrangement for the user support 46. This embodiment illustrates a connecting link from the slide 70 to the exercise arm 44 which is similar to that of FIGS. 13 and 14, and like reference numerals have been used for like parts as appropriate. In this embodiment, as in the previous embodiment and that of FIGS. 13 and 14, the exercise arm 44 pivots on the frame at its lower end via pivot 45. However, rather than pivoting on the same pivot 45, the lower bar or struts 52 of the user support are pivoted to the exercise arm 44 at a pivot 192 spaced above pivot 45. This arrangement produces the same amount of movement of the user support as the embodiment of FIGS. 13 and 14. However, the exercise arm 44 moves through a slightly greater angle than the embodiment of FIGS. 13 and 14, and thus the resistance will be slightly reduced.

Figure 32:
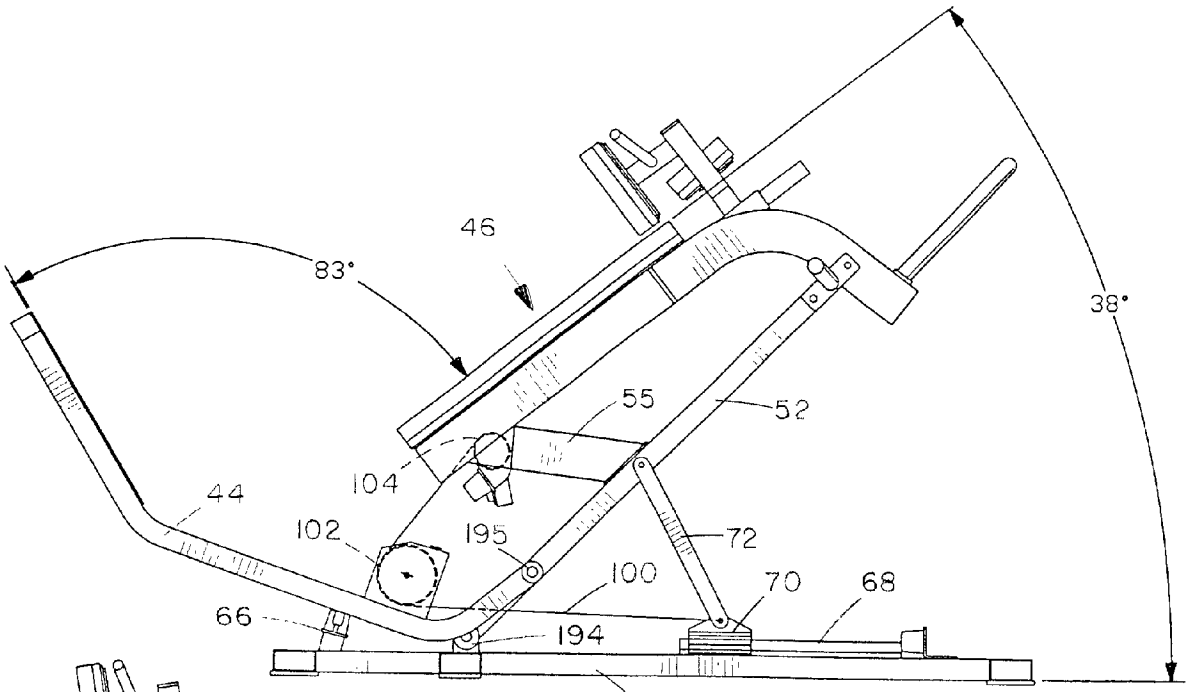
FIG. 32 is a side elevational view of the machine of FIG. 31, illustrating the fully extended position.
Figure 31:
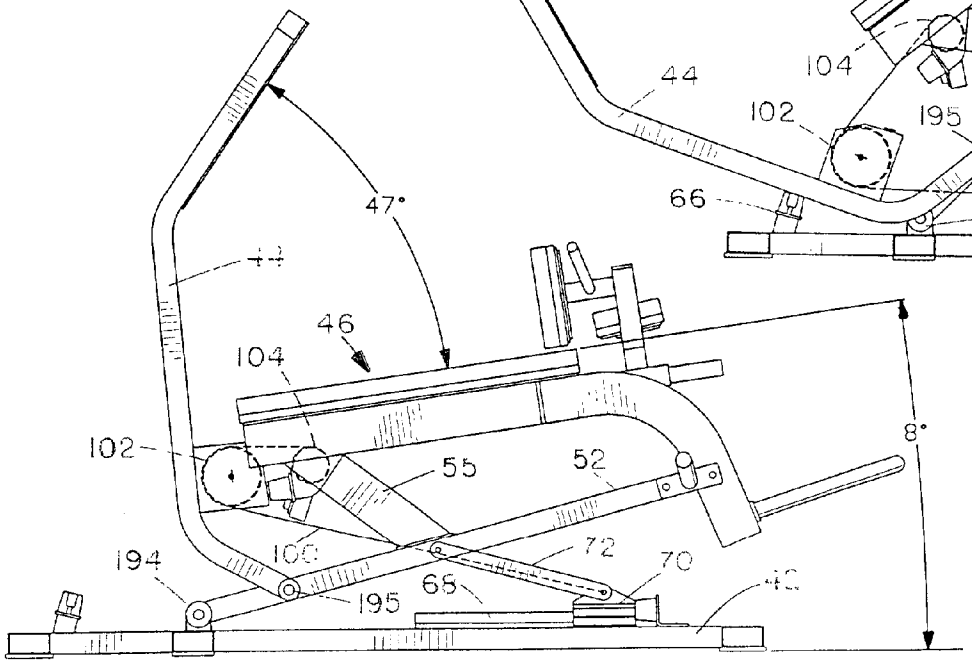
FIG. 31 is a side elevational view of a composite motion machine according to a thirteenth embodiment of the invention, showing the machine in a starting exercise position.

FIGS. 31 and 32 illustrate another modified pivoting arrangement, which is the reverse of the previous embodiment. In this embodiment, the lower bar or struts 52 of the user support pivot directly on the frame 42 via pivot 194, while the exercise arm 44 pivots on the lower bar or struts 52 via pivot 195 which is spaced above the pivot 194. The exercise machine of FIGS. 31 and 32 is otherwise identical to that of FIGS. 13 and 14, and like reference numerals have been used for like parts as appropriate. In this embodiment, the user support moves through an angle of 30 degrees between the start and fully extended positions illustrated in FIGS. 13 and 14, while the exercise arm 44 moves through an angle of 70 degrees.

Figure 34:
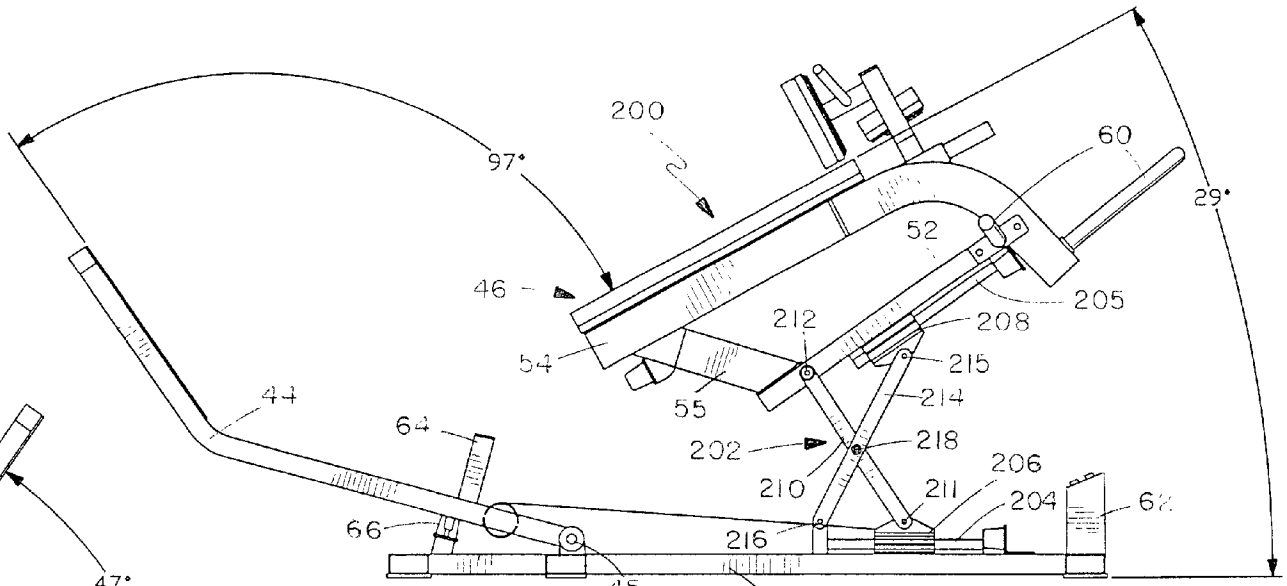
FIG. 34 is a side elevational view of the machine of FIG. 33, illustrating the fully extended position.
Figure 33:
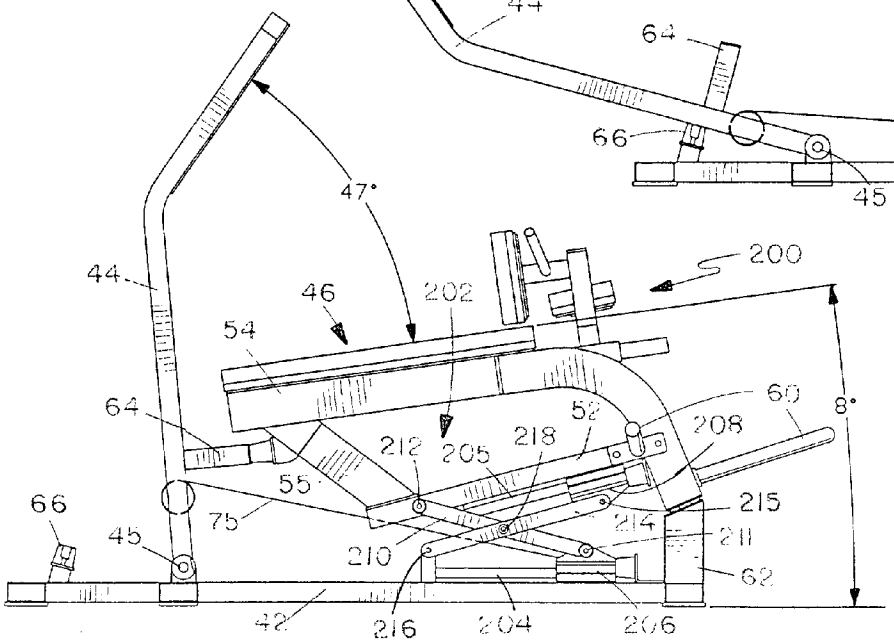
FIG. 33 is a side elevational view of a composite motion machine according to a fourteenth embodiment of the invention, showing the machine in a starting exercise position.

FIGS. 33 and 34 illustrate an exercise machine 200 which has a similar main frame 42, exercise arm 44, and user support 46 as the first embodiment, and like reference numerals have been used for like parts as appropriate. However, in this embodiment, a modified, scissors-like dual slide and linkage system 202 is used in place of the pivotal linkage system 48 of FIGS. 1 to 6. In this version, there is a slide rail 204,205 mounted on both the main frame 42 and the lower struts 52 of the user support, respectively. A slide or traveling member 206,208, respectively, is associated with each slide rail 204,205. A first pivoting link 210 is pivoted at one end 211 to the slide 206 on the slide rail 204 and at the other end 212 to the lower strut 52 of the user support. A second pivoting link 214 is pivoted at one end 215 to the slide 208 on the slide rail 205 and at the other end 216 to the main frame 42. The two links 210,214 are pivoted together via pivot 218 at their cross over point spaced between their respective ends. Cable 75 connects the slide 206 to the exercise arm 44.

With the linkage arrangement of FIGS. 33 and 34, when the exercise arm 44 is moved, the connection means or cable 75 forces the slide 206 to move, and thereby causes the links 210 and 214 to "scissor", pulling slide 208 along rail 205 and also causing the user support 46 upward and forward, as indicated in FIG. 34. In this embodiment, unlike the previous arrangements, the user support 46 does not pivot directly on either the main frame or the exercise arm, but is instead pivotally mounted on the frame only by the dual, scissoring linkage system 202. This arrangement produces about the same amount of angular movement of the user support and exercise arm as that of FIGS. 1 to 6.

Figure 36:
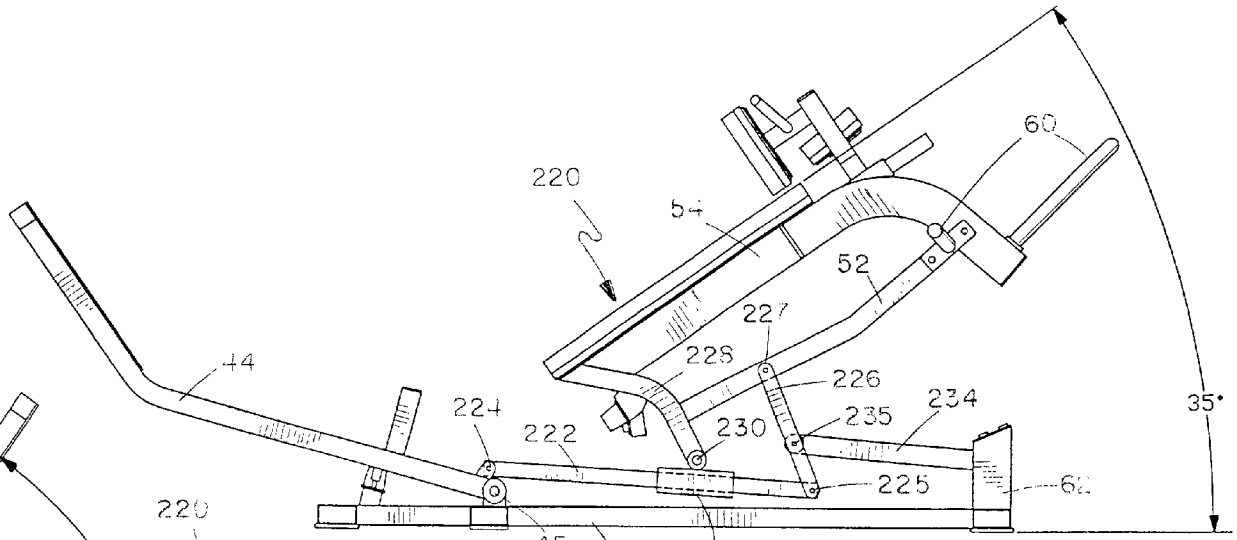
FIG. 36 is a side elevational view of the machine of FIG. 35, illustrating the fully extended position.
Figure 35:
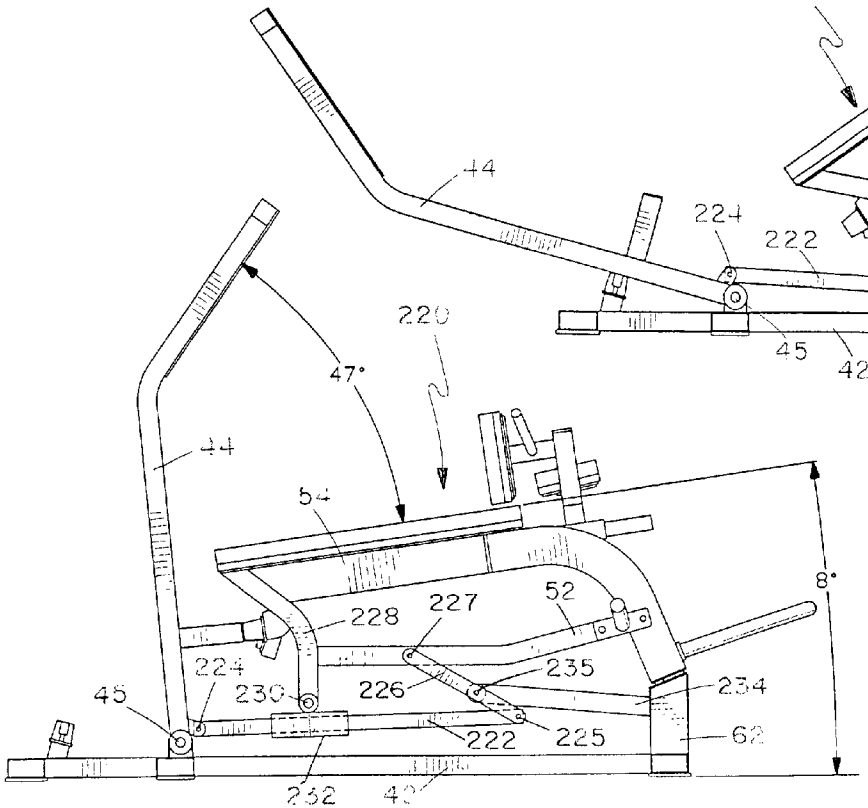
FIG. 35 is a side elevational view of a composite motion machine according to a fifteenth embodiment of the invention, showing the machine in a starting exercise position.

FIGS. 35 and 36 illustrate another modified leg press exercise machine 220 which has some parts which are the same as the first embodiment, and like reference numerals have been used for like parts as appropriate. However, in this embodiment, the user support is not pivoted directly on the main frame, and the sliding, pivotal linkage assembly is different from all of the previous embodiments.

The machine 220 has a main frame 42 and an exercise arm 44 pivoted to the main frame at its lower end for rotation about pivot axis 45. A slide rail 222, which also acts as a connecting link, is pivoted at one end to the exercise arm 44 via pivot 224. The opposite end of rail 222 is pivoted via pivot 225 to a link 226 which is pivoted at its upper end to the lower strut 52 of the user support 46, via pivot 227. A forward end strut 228 of the user support has a lower end which is pivotally connected at pivot 230 to a slide 232 engaged over slide rail 222. A second link 234 has one end pivoted to the first link 226 at a pivot 235 intermediate the ends of link 226, and a second end of link 234 is secured to the stand off or stop member 62. In this case, there is no slide rail mounted directly on the support frame or the user support, but instead the slide rail 222 is suspended and acts also as the connecting link. Also, the user support is not directly pivoted to the frame, but indirectly via the pivot connection to the slide 232, and via the links 226 and 234.

When the exercise arm 44 is moved from the start position illustrated in FIG. 35, the slide rail or link 222 will pull on the end of the first connecting link 226, pulling it to the left. At the same time, the link 226 will pivot about its connection 234 to the main frame at pivot 235, and will force the user support 46 to move in a forward/upward direction. The user support 46 will pivot about its pivot connection 230 to the slide 232. As the user support is raised, the slide moves along the rail or connecting link 222, adjusting to the change in position of the user support. This arrangement produces movement of the user support through an angle of approximately 27 degrees, while the exercise arm 44 moves through an angle of around 70 degrees.

Figure 38:
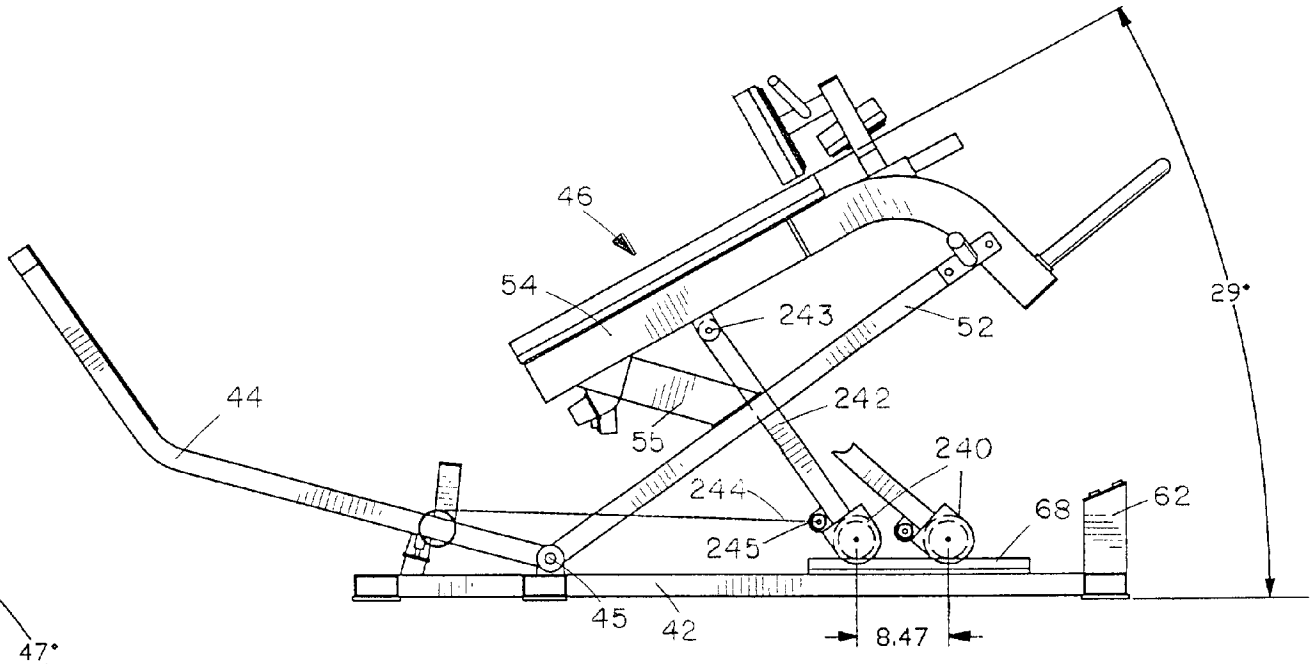
FIG. 38 is a side elevational view of the machine of FIG. 37, illustrating the fully extended position.
Figure 37:
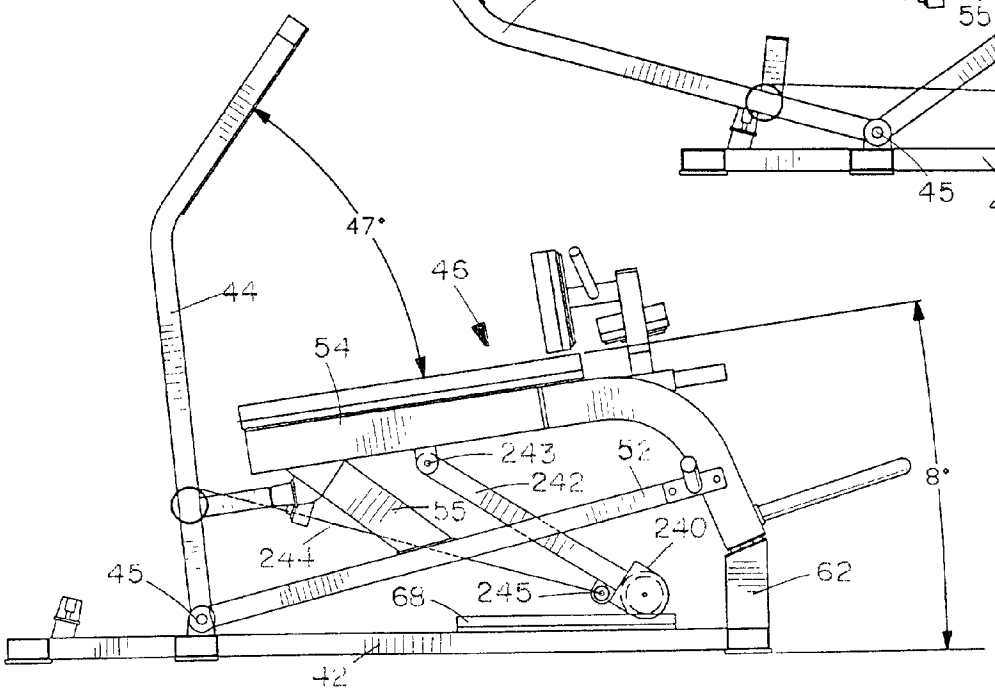
FIG. 37 is a side elevational view of a composite motion machine according to a sixteenth embodiment of the invention, showing the machine in a starting exercise position.

FIGS. 37 and 38 illustrate a modification of the exercise machine 40 of FIGS. 1 to 7, in which the linear slide 70 is replaced with a wheel or roller 240 which is fixedly connected to one end of the connecting link 242. The opposite end of connecting link 242 is pivoted to the upper support or seat support 54 of the user support 46, via pivot 243. A connecting cable or belt 244 is connected at one end to a point or anchor 245 just above the wheel or roller 240, and at its opposite end to the exercise arm 44.

FIG. 37 illustrates the machine in a starting position, while FIG. 38 illustrates the components in a fully extended position at the completion of an exercise movement. As the exercise arm 44 is pushed back, cable 244 pulls on wheel 240, pulling it along the slide rail 68 and simultaneously raising link 242 and thus urging the user support 46 upwardly and forward. The round shape of the wheel or roller 240 automatically adjusts for position along the rail 68, so that a pivotal connection between the wheel 240 and link 242 is not required. Thus, the pivot previously attaching the link to the linear slide can be eliminated. The wheel also does not need the special hardened shafting which will be required for a linear slide, further reducing cost and maintenance. The machine of FIGS. 37 and 38 produces the same amount of movement as that of FIGS. 1 to 6, but with increased simplicity, fewer parts, and reduced expense. FIG. 38 illustrates the movement of wheel 240 along the rail from the start position, to the right, up to the fully extended position. As illustrated, the wheel moves only 8.47 inches between these two positions, such that no pivot is required between the wheel and link 242, and the small amount of movement will produce substantially reduced wear on the rail over the prior art arrangement of FIGS. 43 and 44.

Figure 42A:
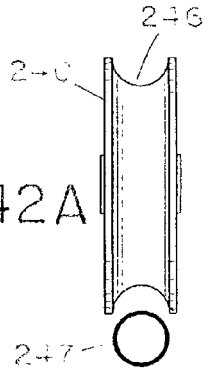
FIGS. 42A to 42D illustrate various alternative versions of the slide rail and mating wheel of FIGS. 38 to 41.
Figure 42B:
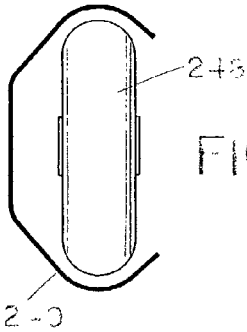
Figure 42C:
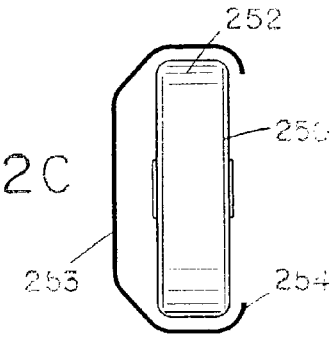
Figure 42D:
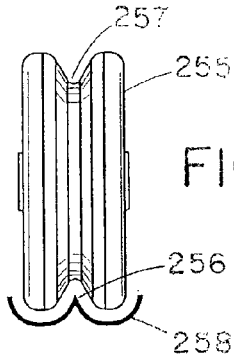

FIGS. 42A to 42D illustrated various alternative versions for the mating of the wheel 240 with a slide rail. FIG. 42A illustrates the version illustrated in FIGS. 37 and 38, in which wheel 240 has a concave rim 246 which runs over a convex rail surface 247. In the alternative illustrated in FIG. 42B, a wheel 248 has a convex outer rim and runs in a channel 249 with concave wheel rim engaging surfaces. FIG. 42C illustrates a wheel 250 with a flat rim or radius 252 which runs in a channel 253 with a flat rim surface having raised edges 254 to match the radius of the wheel. In FIG. 42D, the wheel 255 has a groove 257 which runs over a ridged surface 256 of the rail 258. This helps keep the wheel in place on the rail. The wheel may run over a single rail as in FIGS. 42A or 42D, or may be captured in a channel or between two rails as in FIGS. 42B or 42C. It will be understood that any of these alternative wheel and rail arrangements may be used in place of the wheel and rail of FIGS. 37 and 38.

Figure 40:
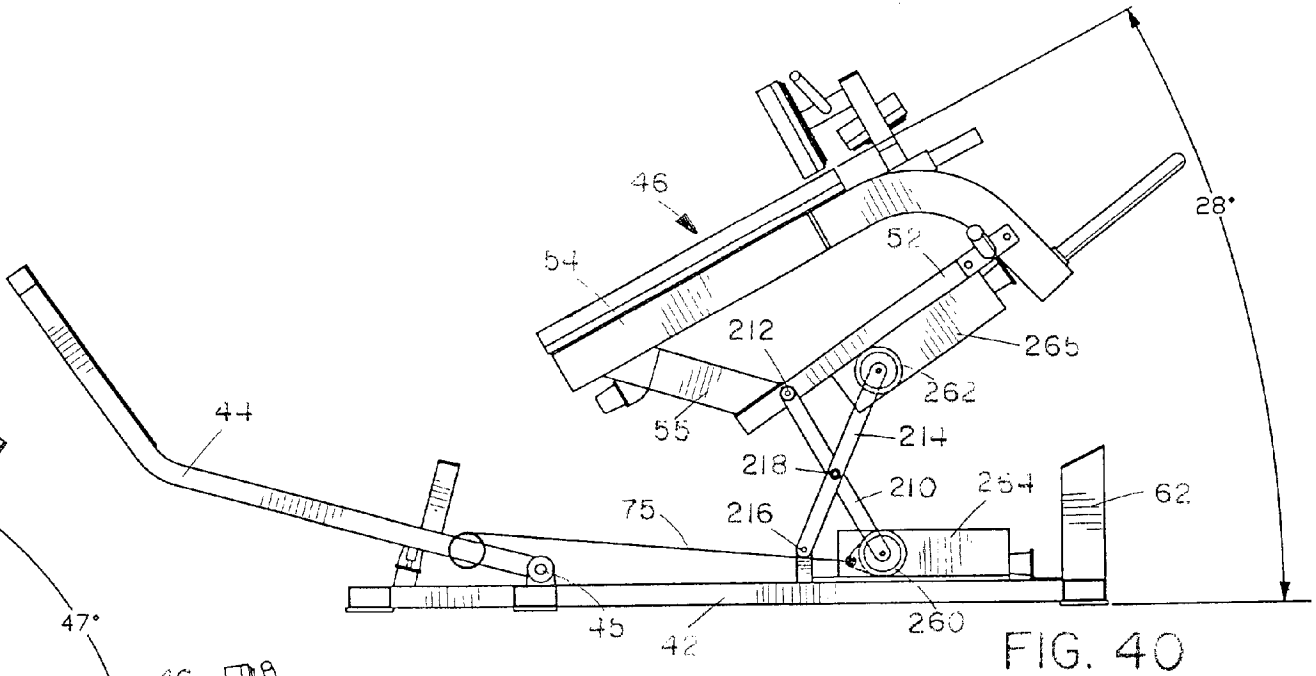
FIG. 40 is a side elevational view of the machine of FIG. 39, illustrating the fully extended position.
Figure 39:
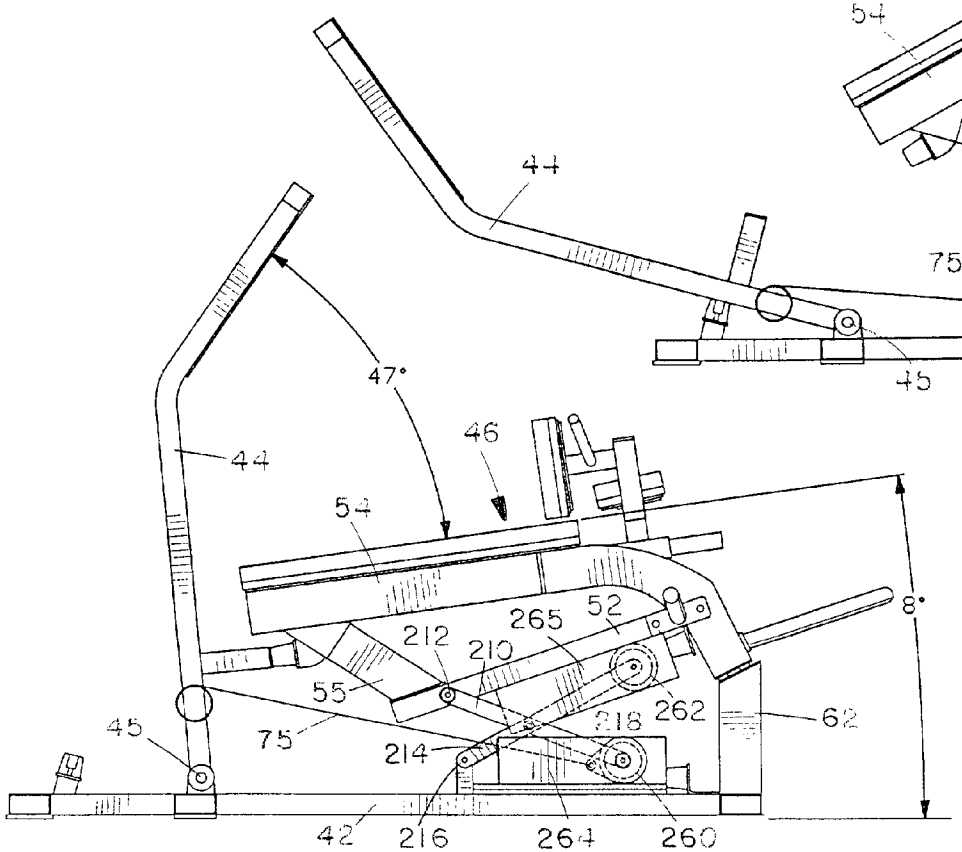
FIG. 39 is a side elevational view of a composite motion machine according to a seventeenth embodiment of the invention, showing the machine in a starting exercise position.

FIGS. 39 and 40 illustrate a modification of the dual scissoring linkage version of FIGS. 33 and 34, in which the linear slides 206 and 208 and pivot connections 211,215 are each replaced with a wheel or roller 260,262 respectively. The single slide rails 204,205 of FIGS. 33 and 34 are replaced with slide channels or opposing slide rails 264,265, respectively, which may be of the type illustrated in FIG. 42B or 42C. The parts in FIGS. 39 and 40 are otherwise identical to those of FIGS. 33 and 34, and like reference numerals have been used as appropriate.

Since the two wheels 260,262 will rotate as they move along the respective channels, they can be rigidly connected to the respective links 210,214, eliminating the need for the pivots 211 and 215 of FIGS. 33 and 34. As in the previous embodiment with the scissoring link, the two links 210,214 are pivoted together at their crossover point 218, with link 210 pivoted to the lower strut 52 of the user support at 212 and link 214 pivoted to the user support 42 at 216. The wheel 260 is connected to the exercise arm 44 via cable 75.

As exercise arm 44 is pushed from the start position of FIG. 39 towards the fully extended position of FIG. 40, cable 75 will pull wheel 260 to the left, causing links 210,214 to scissor upwardly, simultaneously lifting the user support 46 upwardly and forward. The amount of movement of the exercise arm 44 and user support 46 is equivalent to that of FIGS. 37 and 38, while the number of components is reduced, since two pivots are eliminated.

Figure 41:
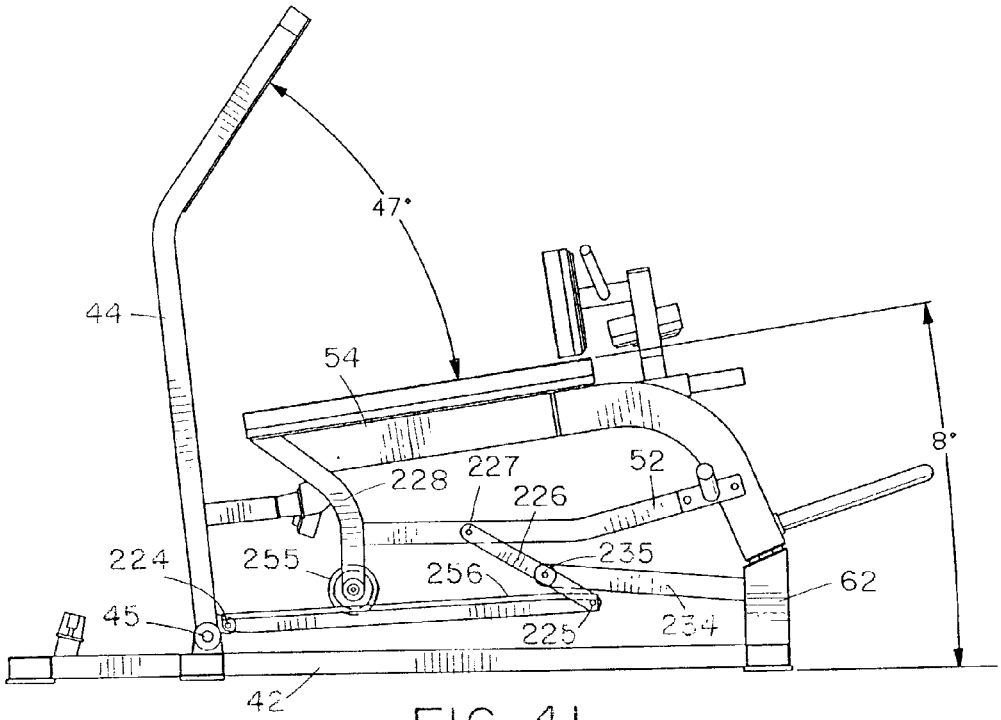
FIG. 41 is a side elevational view illustrating a modification of the machine of FIGS. 35 and 36, in which the slider sleeve is replaced with a roller.

FIG. 41 illustrates a modification of the machine 220 of FIGS. 35 and 36, in which the linear slide 232 and rail 222 are replaced by a roller 255 and rail 256 as illustrated in FIG. 42D. The components are otherwise identical to those of FIGS. 35 and 36, and like reference numerals have been used for like parts as appropriate. The roller 255 has a groove which engages over a ridge on rail 256, helping to keep the wheel in place. However, alternatively, any of the wheel and rail arrangements of FIGS. 42A to 42C may be used in this embodiment.

The amount of movement provided by the modified machine of FIG. 41 will be more or less the same as for the machine of FIGS. 35 and 36. However, there will be no need for a pivot between the roller 255 and the front end strut 228, since the rotation of the wheel or roller 255 will automatically adjust for the position of the strut 228 along the rail. As the exercise arm 44 is pushed away from the start position of FIG. 41, wheel 255 will be moved to the right along the slide rail 256, and link 226 will be pivoted upwardly, forcing the user support 46 to move upwardly and forward into the position illustrated in FIG. 36.

In all of the various exercise machines described above, the common elements of an exercise arm, a main frame, a user support, a sliding linkage system, a connection means, and a load are present. In FIGS. 1 to 34, a pivoting link is pivotally attached to a slide and to either the user support or the main frame. In FIGS. 35 and 36, the slide is pivotally attached to the user support, and the pivoting link is pivotally attached to the user support, the main frame, and another connecting link or slide rail. In FIGS. 37 to 41, a wheel replaces the or each linear slide.

It should be understood that all the different elements used in the different embodiments may be mixed and interchanged with one another in alternative versions of the invention. The slide support rail may be mounted on the main frame, on the user support, may act as a connecting link, or be incorporated as a structural part of the main frame or user support. The slide or slides may be pulled or pushed in a forward or rearward direction, by various types of connection means. The connecting link can pivot on the main frame, user support, linear slide, and/or a second connecting link or rail. The shape or type of wheel and its mated rail may vary. A wheel may replace one or more linear slides. The location of, and the relationship between, the exercise arm pivot and the user support pivot may vary. The type of load may vary and its connection to one or more of the various moving elements, such as the exercise arm, user support, or sliding linkage, may be varied.

The exercise machines of the various alternative embodiments described above all provide movement of an actuating member or exercise arm and a user support in a dependent relationship, providing an exercise movement which blends with the natural movement of the human body, providing a safer, more comfortable exercise. The machine can be designed for various different relationships between the travel of the exercise arm and the travel of the user support, from an exercise arm moving faster and over a longer distance than the user support, to the exercise arm and user support moving in a 1:1 relationship over the same distance and at the same speed, or to a user support which travels farther and faster than the exercise arm, providing resistance in a greater than 1:1 ratio.

The exercise machine of this invention is capable of producing the same movement of the exercise arm and user support as a prior art composite motion machine, but with a shorter slide rail and fewer parts, reducing maintenance and increasing component lifetime. The exercise arm may be a leg press member or an upper body exercise member, as in the illustrated embodiments, or may alternatively be any type of actuating member or exercise arm as known in the field. It will be understood that all of the alternative arrangements of FIGS. 1 to 22 and 25 to 41 may alternatively be used on the upper body exercise machine as illustrated in FIGS. 23 and 24, or any other type of exercise machine.

Although some exemplary embodiments of the invention have been described above by way of example only, it will be understood by those skilled in the field that modifications may be made to the disclosed embodiments without departing from the scope of the invention, which is defined by the appended claims.

The invention claimed is:

1. An exercise machine, comprising:

a stationary main frame device;

a user support device pivotally linked directly to the main frame device;

an exercise arm device pivotally linked to the main frame device, the exercise arm device having a first user engagement means for engagement only by the user's hands or feet when performing exercise;

a second user engagement means secured to the user support device for engagement by the user's hands or feet to brace the user during exercise, the second user engagement means being fixed relative to the user support device at least during exercise movement;

a slide rail linked to a first one of said devices;

a traveling member engaging the slide rail for movement in a straight, linear path along the rail;

a first rigid connecting link being elongate between opposite first and second ends, the first end of the connecting link being connected to the traveling member, and the second end of the connecting link being linked to a fixed position on a second one of said devices; and a connection means linking the traveling member to the exercise arm device.

2. The machine as claimed in claim 1, wherein the slide rail is mounted on the main frame device and the second end of the connecting link is linked to the user support device.

3. The machine as claimed in claim 1, wherein the slide rail is mounted on the user support device and the second end of the connecting link is linked to the main frame device.

4. The machine as claimed in claim 1, wherein the slide rail is linked to the exercise arm device and the second end of the connecting link is linked to the user support device.

5. The machine as claimed in claim 1, wherein the traveling member is a wheel for rolling along the slide rail.

6. The machine as claimed in claim 1, wherein the exercise arm comprises a leg press member.

7. The machine as claimed in claim 1, wherein the exercise arm comprises an upper body exercise member.

8. The machine as claimed in claim 1, wherein said connection means comprises a link arm having a first end pivoted to said traveling member and a second end pivoted to said exercise arm device.

9. The machine as claimed in claim 8, wherein said link arm is adjustable in length.

10. The machine as claimed in claim 1, wherein said connection means comprises a belt and pulley linkage extending from said traveling member to said exercise arm and terminating at said user support.

11. The machine as claimed in claim 1, wherein said connection means comprises a belt, a first pulley on said traveling member, a second pulley on said exercise arm, said belt extending from said main frame device around said first pulley and said second pulley and linked to said user support device.

12. The machine as claimed in claim 1, wherein said connection means comprises a cable, a pulley on said main frame, said cable extending from said traveling member around said pulley and up to said exercise arm device.

13. The machine as claimed in claim 1, wherein said connection means comprises a link arm having a first end pivoted to said exercise arm and a second end pivoted to said first connecting link.

14. The machine as claimed in claim 1, wherein the exercise arm device and user support device are both directly pivoted to the main frame device.

15. The machine as claimed in claim 14, wherein the user support and exercise arm device are pivoted about the same pivot axis.

16. The machine as claimed in claim 14, wherein the user support and exercise arm device are pivoted about co-linear separate pivots.

17. The machine as claimed in claim 1, wherein the exercise arm device is pivoted directly on the main frame and the user support device is pivoted to the exercise arm device.

18. The machine as claimed in claim 1, wherein the user support device is pivoted directly on the main frame and the exercise arm device is pivoted to the user support device.

19. An exercise machine, comprising:

a stationary main frame device;

a user support device pivotally linked to the main frame device;

an exercise arm device pivotally linked at a lower end to the main frame device;

a slide rail linked to a first one of said devices;

a traveling member engaging the slide rail for movement along the rail;

a first connecting link being elongate between opposite first and second ends, the first end of the connecting link being connected to the traveling member, and the second end of the connecting link being linked to a fixed position on a second one of said devices;

a connecting link directly linking the traveling member to the exercise arm device; and the traveling member comprising a linear slide.

20. The machine as claimed in claim 19, including a second slide rail mounted on the second device, a second traveling member mounted for movement back and forth along said second slide rail, and a second connecting link having a first end linked to said second traveling member and a second end linked to a fixed position on said first device, the first and second connecting links crossing over at a cross-over point and being pivotally connected at said cross-over point to form a scissors-like linkage.

21. The machine as claimed in claim 20, wherein the first slide rail is mounted on the main frame device and the second slide rail is mounted on the user support device.

22. An exercise machine, comprising:

a stationary main frame device;

a user support device pivotally linked directly to the main frame device;

a single exercise arm device having a first user engagement means for engagement by one pair of extremities of a user while performing exercise, the extremities comprising the user's hands or feet, the exercise arm device being pivotally linked to the main frame device and being urged by a user in one direction to perform an exercise;

a second user engagement means secured to the user support device for engagement by the other pair of extremities of the user to brace the user during exercise, the second user engagement means being fixed relative to the user support device at least during exercise movement;

a slide rail linked to a first one of said devices;

a traveling member engaging the slide rail for movement along the rail;

a first rigid connecting link being elongate between opposite first and second ends, the first end of the connecting link being connected to the traveling member, and the second end of the connecting link being linked to a fixed position on a second one of said devices;

a connection means linking the traveling member to the exercise arm device; and an exercise resistance linked to one of said devices for providing an additional, adjustable exercise load.

23. The machine as claimed in claim 22, wherein the exercise resistance is linked to said user support.

24. The machine as claimed in claim 23, wherein the user support has a weight peg of predetermined length sufficient for receiving weight plates comprising said exercise resistance.

25. The machine as claimed in claim 22, wherein the exercise resistance is linked to said traveling member.

26. The machine as claimed in claim 22, wherein the exercise resistance is linked to said exercise arm.

27. The machine as claimed in claim 22, wherein said exercise resistance comprises a weight stack.

28. The machine as claimed in claim 22, wherein the exercise resistance comprises weight plates.

29. An exercise machine, comprising:

a stationary main frame device;

a user support device pivotally linked directly to the main frame device;

an exercise arm device pivotally linked to the main frame device;

a slide rail linked to a first one of said devices;

a traveling member engaging the slide rail for movement along the rail;

a first connecting link having opposite first and second ends, the first end of the connecting link being connected to the traveling member, and the second end of the connecting link being pivotally linked to a fixed position on a second one of said devices;

a connection means linking the traveling member to the exercise arm device; and said connection means comprising a belt linking said traveling member to said exercise arm device.

30. An exercise machine, comprising:

a stationary main frame device;

a user support device for providing a single support for the user's torso, the user support device being pivotally linked directly to the main frame device at a single pivot location;

a single exercise arm device for engagement by the hands or feet of a user while performing exercise, the exercise arm device being pivotally linked to the main frame device, whereby the user actuates only the single exercise arm device in order to perform exercise on the machine;

a first user engagement means secured to the exercise arm device for engagement only by one pair of the user's extremities when performing exercise;

a second user engagement means secured to the user support device for engagement by the other pair of extremities of the user to brace the user during exercise, the second user engagement means being fixed relative to the user support device at least during exercise movement;

a straight slide rail linked to a first one of said devices;

a traveling member engaging the slide rail for straight, linear movement along the rail;

a first rigid connecting link being elongate between opposite first and second ends, the first end of the connecting link being connected to the traveling member, and the second end of the connecting link being linked to a fixed position on a second one of said devices;

a connection means linking the traveling member to the exercise arm device; and the user support and exercise arm device both being directly pivoted at spaced locations on the main frame device.

31. An exercise machine, comprising:

a stationary main frame device;

a user support device pivotally linked to the main frame device;

a single exercise arm on the main frame device comprising a rigid, one-piece member which is engaged by the user for exercise movement in one direction only, the exercise arm being pivotally linked at a lower end to the main frame device;

a slide rail mounted on a first one of said main frame and user support devices;

a traveling member engaging the slide rail for movement along the rail in a straight, linear path;

a first connecting link being elongate between opposite first and second ends, the first end of the connecting link being connected to the traveling member, and the second end of the connecting link being linked to a fixed position on a second one of said devices; and a connection means directly linking the traveling member to the exercise arm.

32. The machine as claimed in claim 31, wherein the traveling member comprises a wheel and the first connecting link is rigidly secured to the wheel at its first end and pivoted to the other device at its second end.

33. The machine as claimed in claim 31, wherein the slide rail is horizontal.

34. An exercise machine, comprising:

a stationary main frame device;

a single user support device pivotally linked directly to the main frame for providing the entire support for a user's torso when performing exercise, the user support device having no parts which move relative to one another during an exercise movement;

one exercise arm only pivotally linked at a lower end to the main frame device for urging by a user in one direction only when performing exercise;

a slide rail mounted on a first one of said main frame and user support devices;

a traveling member engaging the slide rail for movement along the rail;

a first connecting link having opposite first and second ends, the first end of the connecting link being connected to the traveling member, and the second end of the connecting link being pivotally linked to a fixed position on a second one of said devices;

a connection means linking the traveling member to the exercise arm; and the traveling member comprising a linear slide, the first connecting link being pivoted to the traveling member at its first end and being pivoted to the other device at its second end.

* * * * *